US007325283B2

(12) United States Patent
Storchenegger et al.

(10) Patent No.: US 7,325,283 B2
(45) Date of Patent: Feb. 5, 2008

(54) METHOD AND DEVICE FOR THREAD DISTRIBUTION IN A WARPING FRAME

(75) Inventors: Richard Storchenegger, Meilen (CH); Lukas Kunz, Küssnacht (CH)

(73) Assignee: Benninger AG, Uzwil (CH)

( * ) Notice: Subject to any disclaimer, the term of this patent is extended or adjusted under 35 U.S.C. 154(b) by 0 days.

(21) Appl. No.: 11/718,819

(22) PCT Filed: Nov. 9, 2005

(86) PCT No.: PCT/EP2005/055867

§ 371 (c)(1),
(2), (4) Date: Jul. 23, 2007

(87) PCT Pub. No.: WO2006/051085

PCT Pub. Date: May 18, 2006

(65) Prior Publication Data

US 2007/0266535 A1 Nov. 22, 2007

(30) Foreign Application Priority Data

Nov. 10, 2004 (EP) ..... 04026668
Nov. 11, 2004 (EP) ..... 04026841

(51) Int. Cl.
*D02H 9/00* (2006.01)

(52) U.S. Cl. ..... 28/198; 28/199; 28/190

(58) Field of Classification Search ..... 28/198, 28/199, 191, 190, 192–196, 197, 202, 184, 28/208

See application file for complete search history.

(56) References Cited

U.S. PATENT DOCUMENTS 3,330,017 A 7/1967 Staubli
3,520,493 A 7/1970 Carroll
4,152,815 A * 5/1979 Altenweger ..... 28/198
4,683,625 A 8/1987 Baltzer
4,765,041 A 8/1988 Baltzer
4,893,386 A * 1/1990 Thier et al. ..... 28/191
5,206,976 A * 5/1993 Aihara et al. ..... 28/198
5,531,001 A * 7/1996 Beerli ..... 28/198
5,590,448 A * 1/1997 Lenzen et al. ..... 28/191
5,628,098 A * 5/1997 Beerli et al. ..... 29/191
6,401,314 B1 * 6/2002 Spring et al. ..... 28/191

FOREIGN PATENT DOCUMENTS

| | | |
|---|---|---|
| DE | 4443627 | 6/1996 |
| EP | 1460156 | 9/2004 |
| FR | 2409949 | 6/1979 |
| GB | 2002431 | 2/1979 |
| GB | 2034778 | 6/1980 |
| JP | 60067366 | 4/1985 |
| WO | 2004/026746 | 4/2004 |

* cited by examiner

*Primary Examiner*—A. Vanatta
(74) *Attorney, Agent, or Firm*—Shoemaker and Mattare

(57) ABSTRACT

The invention relates to a method for thread distribution in a warping frame (1) which comprises a yarn package (2) for coiling a coil consisting of a plurality of threads (18). According to said method, a warp for producing a thread crossing or thread separation is produced, while the yarn package rotates, at the start and/or the end of a coil in a circumferential area of the yarn package (2) using warp shedding combs (40, 40*a*, 40*b*) disposed in the circumferential area of the coil (2). A partial element, especially a partial thread (49) or an auxiliary crossing rod (34, 56) is introduced into the open warp (51) while the yarn package rotates.

19 Claims, 26 Drawing Sheets

Figure 3:
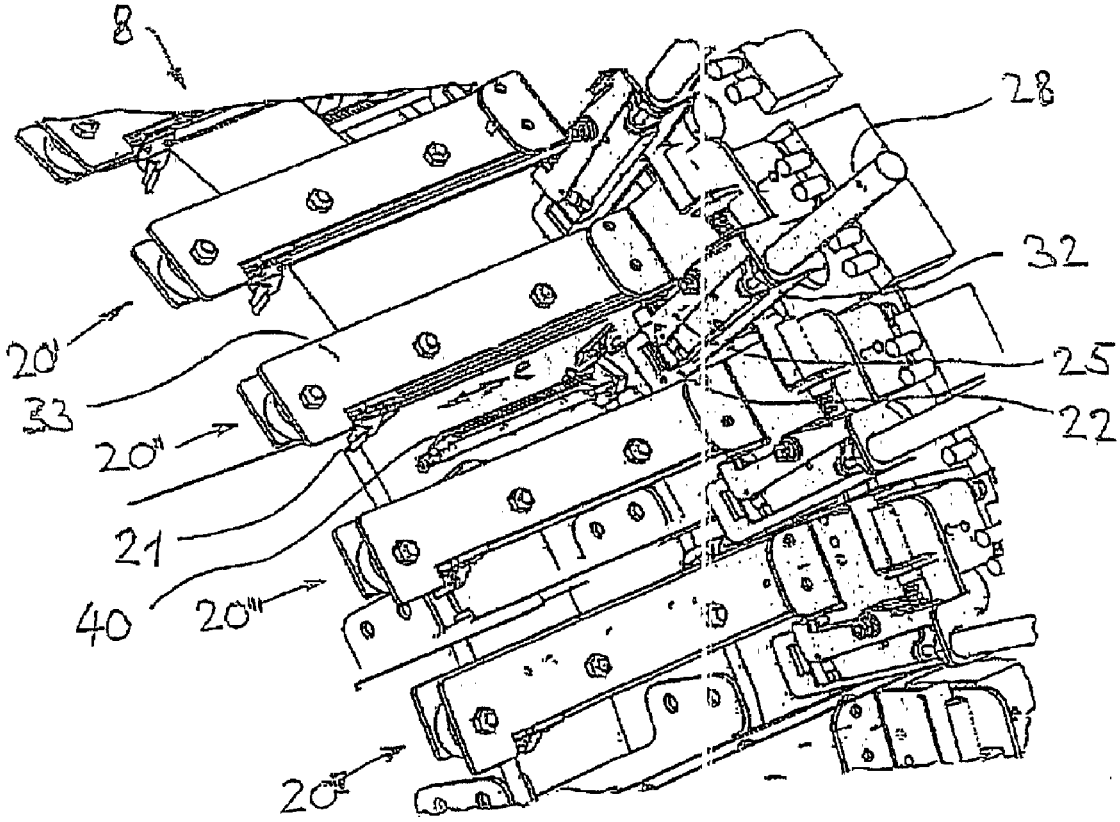

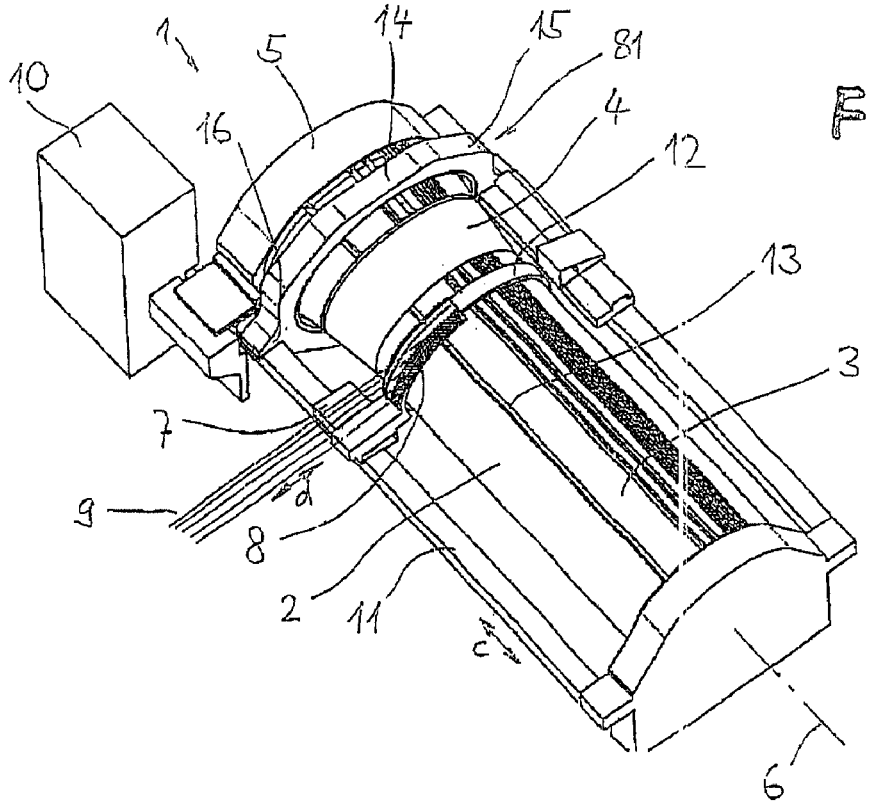
Fig. 1
Fig. 2
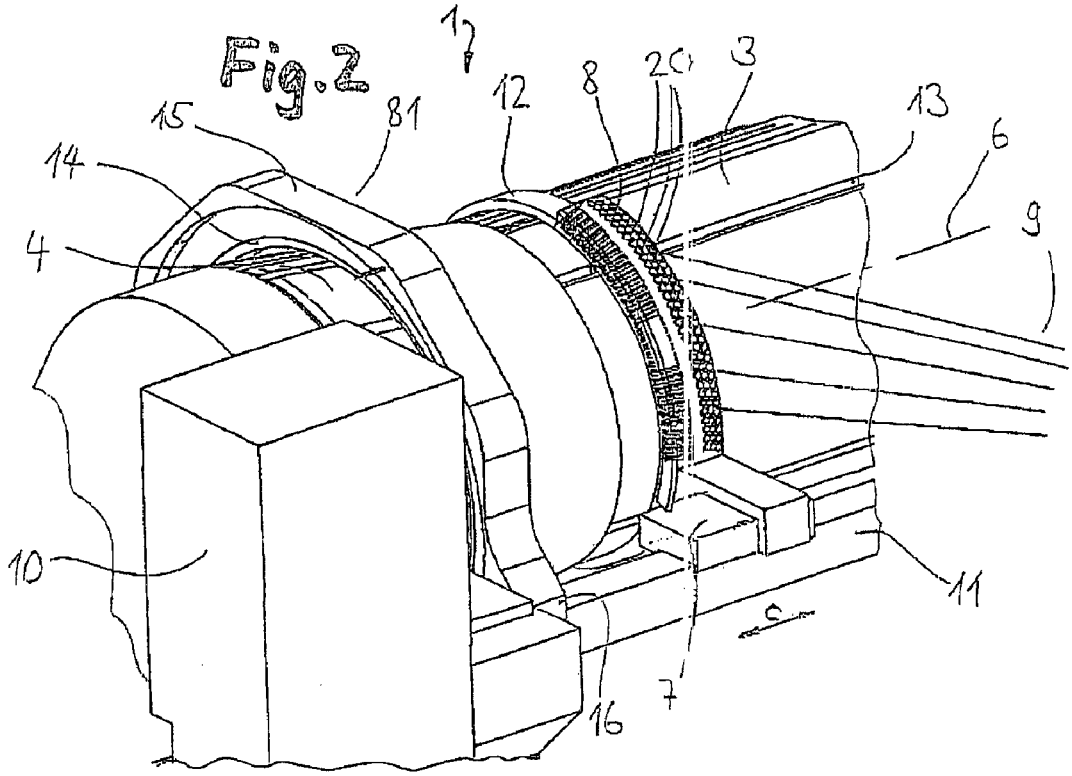

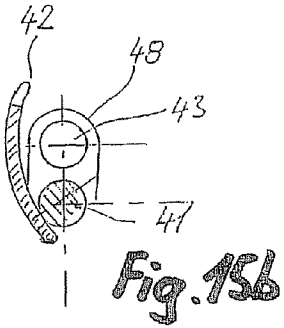
Fig. 15b
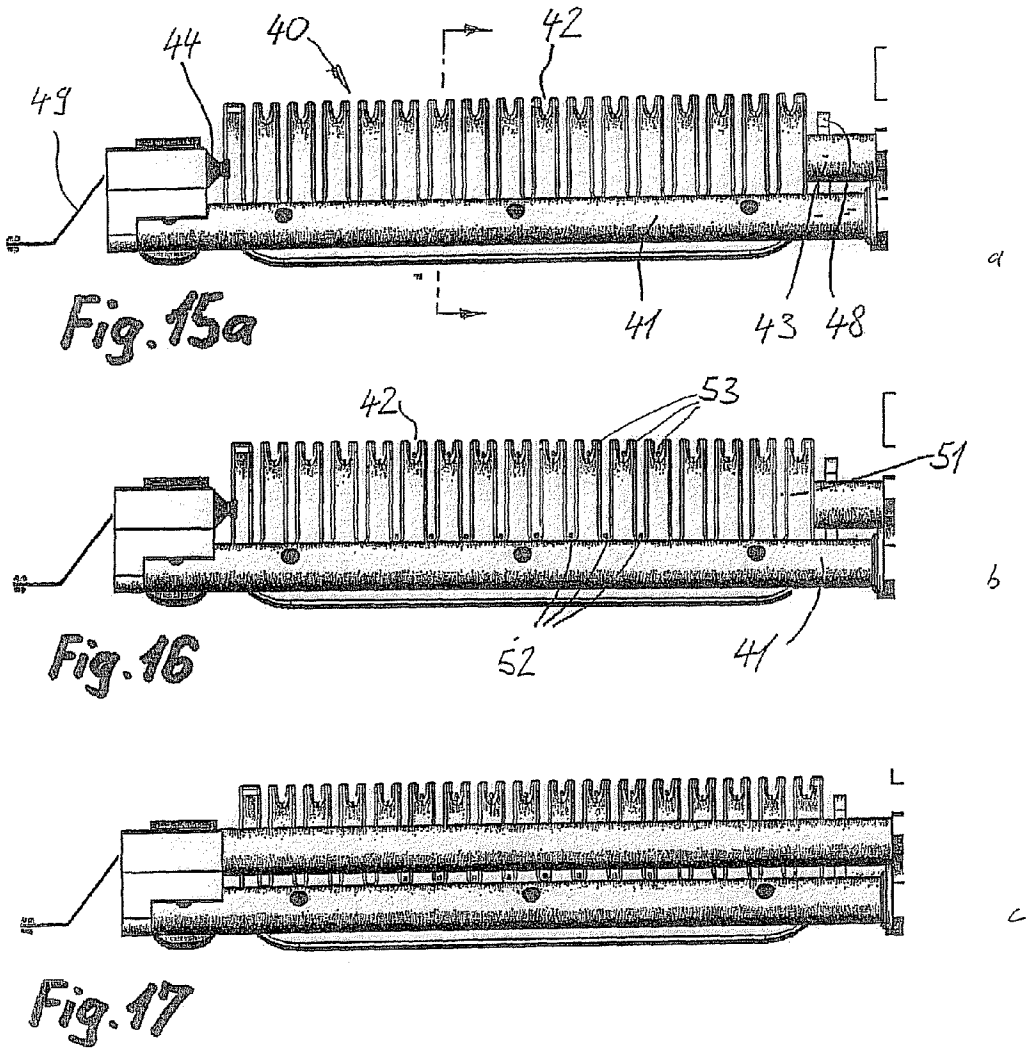
Fig. 15a
Fig. 16
Fig. 17

8
1
81
67
9
21

8
9
67
81
6
18
2
1

METHOD AND DEVICE FOR THREAD DISTRIBUTION IN A WARPING FRAME

The present invention relates to a method and a device for thread distribution on a warping frame. Warping frames for winding a strip consisting of a plurality of parallel threads onto a winding body rotating about an axis of rotation are used, for example, in the textile industry in weaving preparation for warping the warp.

Within a warping process, the correct feed of the warp onto the beam, it is necessary for dividing elements to be introduced into the composite thread structure. In conventional methods, the insertion of dividing elements, as a rule, always requires a standstill at the frame. A method of this type is known, for example, from DE 44 43 627 A1.

An object of the invention, therefore, is to provide a method and a device of the type initially mentioned, by means of which thread distribution in a warping machine is possible without a standstill of the frame. This object is achieved, in terms of the method, by means of a method having the features according to claim 1 and, in terms of the device, by means of a device having the features in claim 9.

At the start and/or at the end of a strip lap, a shed is formed with at least some of the threads at at least one location in a circumferential region of the winding body while the winding body is rotating. A dividing element is then introduced into the open shed. Thread distribution of this type may serve preferably for forming a lease. Such a lease makes it easier later for further processing to be carried out, for example in the weaving mill. Thread distribution of this type may, of course, also be used for size distribution. Shedding, in particular lease formation and the introduction of the dividing element, thus takes place at the full working speed. The method is suitable, on the one hand, for use in conventional warping methods in which the threads are brought to the correct thread density and strip width on the reed. On the other hand, however, the method is also suitable for a warping method in which each individual thread is deposited via an individual thread guide. The winding position of each individual thread on the winding body can thus be defined by means of a thread guide assigned to this thread. The thread guides consequently replace the reed, although, in contrast to the latter, they can move into any desired positions. The thread guides can preferably be adjustable in the direction of the axis of rotation out of a position of rest into a working position. The thread guides can consequently be employed alternately and thus change, as desired, the composition of the strip to be wound. This results in a flying take-over of the working threads onto the winding body. In this case, therefore, both shedding and the take-over of the working threads take place at the full working speed.

The shed may advantageously be formed with the aid of shedding combs which are arranged in the circumferential region of the winding body and which rotate together or synchronously with the winding body. The lease distribution, for example, the corresponding threads can be deposited alternately onto the comb ends and between the comb ends.

The shed may be formed in a particularly advantageous way by threads being deposited onto shedding combs which are arranged on a ring element corotating synchronously with the winding body and surrounding the latter. This method is also suitable particularly for conventional winding bodies, for example for warping drums of known cone warping machines. A special configuration of the warping drum is not absolutely necessary.

Alternatively, the threads may also be deposited directly onto the winding body. For this purpose, the shed is formed by threads being deposited onto shedding combs which are arranged on the winding body. Since the shedding combs are an integral part of the winding body, additional drive and transmission means for generating a synchronous rotation with the winding body may be dispensed with. This method arrangement is suitable particularly preferably for thread distribution at the start of a strip lap.

Particularly with regard to the handling of the warping frame, it may be advantageous if, in the method, shedding takes place at the start and at the end of a strip lap by similar means. The abovementioned ring element may in this case be an inner ring for thread distribution at the start of the strip lap and an outer ring for thread distribution at the end of the strip lap.

Particularly advantageous shedding arises when, for beating up the lease, at least two shedding combs arranged one behind the other on the winding body with respect to the circumferential direction are moved out of a position of rest approximately tangential to the outer circumference into a shedding position in which the comb ends project radially away from the outer circumference, and, in the course of a winding body rotation, the threads are preferably deposited alternately onto the comb ends and between the comb ends. The shedding combs can in this case be moved relatively simply into their working position by means of partial rotation. This method could, of course, also be used, however, for size distribution. There is no leasing here, but, instead, keeping the threads apart from one another. For size distribution, a plurality of shedding combs arranged one behind the other are designed in such a way that a shed is formed in each case only for individual threads. If size distribution is additionally provided, this preferably takes place before leasing.

An auxiliary crossing rod may be introduced into the open shed. The shedding comb forming the respective shed can thereafter be moved into the position of rest again and, lastly, the threads divided by the auxiliary crossing rod can be stripped off onto a dividing element, preferably onto a dividing cord or onto a dividing band. The dividing cord or the dividing band is therefore not actually drawn into the shed, but, instead, the threads are transferred to these dividing elements.

A plurality of strip laps having an identical or a different thread repeat can be wound one against the other or next to one another onto the winding body, the winding body rotating uninterruptedly. The dividing band can in this case be moved from one strip lap to next strip lap by a shedding comb by means of a pushing or pulling movement. For this purpose, for example, during the pivoting movement of the shedding comb into the position of rest, the dividing band can engage via its end portion projecting radially away from the outer circumference into the shedding comb, with the result that the dividing band can be drawn along in a simple way during the displacement of the shedding comb. Alternatively, a pushing movement could also take place during the displacement of the shedding comb.

Likewise, at the end of a strip lap, a lease for shedding may be beaten up with at least part of the threads at at least one location on an outer ring rotating synchronously with the winding body and surrounding the latter, a dividing element being introduced into the opened shed, and shedding preferably taking place by similar means, that is to say by means of shedding combs, to those at the start of the strip lap.

Thus, a plurality of strip laps having an identical or a different thread repeat can be wound onto the winding body one against the other or next to one another, the winding body rotating uninterruptedly.

Particularly advantageously, a thread group consisting of a plurality of threads preferably of different generic type is led up to a thread selection device arranged in the winding region of the winding body, individual threads of this group being drawn off as working threads via the thread guides and forming the strip, while the remaining threads are held clampingly as stock threads on the thread selection device in each case by means of a clamping point. This procedure makes it possible to carry out the strip change while the winding body is rotating continuously, thus obviously speeding up the working process considerably.

In this case, it is advantageous if, after at least one first winding sequence, the working threads of the wound strip are separated and are held clampingly on the thread selection device, and if, in at least one second winding sequence, the working threads of the strip have a composition other than that during the first winding sequence. However, the composition of the strip may also be identical on a plurality of adjacent laps. Finally, it would also be conceivable that the threads of a strip are not separated after each winding sequence, but, instead, the strip is guided at the end of one lap directly to the start of an adjacent lap.

A thread transfer taking place during a full rotation of the winding body can be achieved particularly advantageously when the selected working threads are first tensioned by means of the thread guides into a take-up position above the winding body in which they are freely tensioned, approximately parallel to the axis of rotation, between the thread guides and a clamping point in each case, and in that, in the course of a rotation of the winding body, all the working threads are picked up successively in the take-up position by an inner thread driver assigned to the winding body and are thereafter separated from the clamping point. After separation from the clamping points, the thread guides can be moved with their working threads into the strip winding position over the strip width. This flying transfer of the clamped stock threads as working threads onto the winding body can take place at high speeds and within a single rotation of the winding body.

After the build-up of a strip lap, all the working threads can once again be picked up successively by an outer thread driver corotating synchronously with the winding body and can thereafter be clamped once again by the clamping point and at the same time separated from the thread guide. In practice, therefore, a flying return of the working threads into the standby position at the clamping points again takes place.

On a cone warping frame, it is obviously necessary that the thread selection device for the conical winding of the strip is displaced on a warping table in the direction of the axis of rotation or at right angles to this. The warping drum in this case forms the winding body.

In terms of the device, it is expedient if, for thread distribution on a warping frame, in particular for carrying out the method described above, means for beating up a lease and for introducing a dividing element into a shed opened by the lease, while the winding body is rotating, are arranged at at least one location on the circumferential region of the winding body.

The means for beating up the lease may have at least two shedding combs which are arranged one behind the other with respect to the circumferential direction and approximately parallel to one another and which can be moved out of a position of rest approximately tangential to the outer circumference, in particular by means of a pivoting movement, into a shedding position in which the comb ends project radially away from the outer circumference, the threads being capable of being deposited alternately onto the comb ends and between the comb ends by means of the thread guides. The shedding combs may either be an integral part of the winding body or be released from the winding body.

At least the shedding comb forming the respective shed may be assigned an auxiliary crossing rod which can be introduced parallel to the shedding comb into the open shed in order to introduce the dividing element. It may be advantageous if each shedding comb is assigned an auxiliary crossing rod.

In one embodiment, the dividing element may be a dividing cord which can be drawn off from a preferably cylindrical dividing cord store held next to the shedding comb on the axis of movement of the auxiliary crossing rod. Next to the auxiliary crossing rod may be arranged a thread stripper, by means of which the tensioned threads can be pushed onto the dividing cord via the auxiliary crossing rod fastened on the end face to the dividing cord store and via the dividing cord store.

In an alternative embodiment, on the winding body runs a dividing band which is displaceable parallel to the winding body casing and has an end portion projecting radially away from the outer circumference may. Next to the auxiliary crossing rod may be arranged a thread stripper, by means of which the tensioned separated threads can be pushed from the auxiliary crossing rod onto the dividing band, thread distribution being capable of being maintained with the aid of the end portion. Such a dividing band may consist, for example, of an elongate thin metal strip or plastic strip having a thickness of between 0.1 and 1 mm. The end portion should preferably be designed inflexibly or relatively rigidly, with the result that its position projecting radially away from the outer circumference can be maintained even under mechanical action. After the end of the warping process, a dividing band may be replaced by a dividing cord being drawn in.

The dividing band may be a flexible dividing band which is mounted in the drum interior, can be deflected via the drum end and is displaceable parallel to the winding body casing.

The device may have at least one ring element which can be driven in rotation synchronously with the winding body and surrounds the latter and on which the means for beating up a lease while the winding body is rotating are arranged at at least one location on the circumferential region, the ring element being an inner ring for thread distribution at the start of a strip lap and/or an outer ring for thread distribution at the end of a strip lap. Such an arrangement released from the winding body has various advantages. Thus, existing warping machines can be converted relatively simply. The device is distinguished, further, in that it can be maintained in a simple way.

The means for beating up a lease at the start of a strip lap may, however, also be assigned to the winding body, these being arranged on an inner ring which is displaceable on the winding body surface. This inner ring would therefore be an integral part of the winding body. It may be displaceable synchronously or asynchronously with an outer ring drivable in rotation by means of the winding body and surrounding the latter, for thread distribution at the end of a strip lap.

The ring element may be provided in the region of its outer casing with a toothed rim which can be driven in rotation synchronous with the winding body via a drive shaft. The rotational movement for the ring element can thereby be implemented particularly simply.

Means for displacing the auxiliary crossing rod into an open shed and/or out of an open shed may be provided, which are operatively connected to an auxiliary crossing rod/slotted arrangement which surrounds the winding body and which can be activated by means of deflectors. Additionally or, if appropriate, even alternatively, means for displacing the thread stripper may be provided, which are operatively connected to a thread stripper/slotted arrangement which surrounds the winding body and which preferably can be activated by means of deflectors. For the two directions of movement in each case, two deflectors may be provided in each case. Of course, instead of the deflectors, other control means may also be envisaged.

Further, means for pivoting the shedding combs from the position of rest into the shedding position and in the opposite direction may be provided, which can be activated mechanically by means of an electrically actuable cam control. Thus, action can be taken relatively simply on the rotating shedding comb from outside.

The device for thread distribution may be combined with a device for winding a strip consisting of a plurality of parallel threads onto a winding body drivable in rotation about an axis of rotation. In this device, for each individual thread, a thread guide may be arranged in the circumferential region of the winding body, via which thread guide the respective thread can be wound up and the winding position on the winding body can be fixed.

The thread guides may be an integral part of a thread selection device which may have in each case a clamping point and in each case a thread guide for a plurality of threads, some of these threads being capable of being drawn off via the thread guides as working threads forming the strip, while the remaining threads can be fixed as stock threads in the standby position at the clamping points.

A thread guide and a clamping point may in each case be assigned to a thread guide module which has a gear for adjusting the thread guide and a movable clamping/cutting unit with a clamping unit for clamping the thread and with a cutting device for separating the thread. The cutting and clamping of the threads thus take place virtually at the same location, thus making it possible to have a flying thread change while the winding body is rotating.

The gear of the thread guide module is preferably a traction mechanism with a traction means, in particular with a toothed belt, on which the thread guide is arranged in such a way that it can be moved over a thread guide distance approximately parallel to the axis of rotation of the winding body. The traction mechanism can be moved very quickly and accurately, for example, by means of a stepping motor. Other types of gear could also be envisaged, however, for example a push rod, at the end of which the thread guide is arranged.

The clamping/cutting unit may be mounted movably, approximately at right angles to the thread guide distance, in such a way that the clamping point is displaceable with respect to the winding body circumference between a radially outer position of rest and a radially inner thread transfer position. This stroke movement may be performed, for example, via a pneumatic pressure medium cylinder.

The winding body may be a warping drum of a cone warping frame. The thread selection device may be mounted on a warping table in such a way that it is displaceable both parallel to and at right angles to the axis of rotation of the drum.

The inner and the outer thread driver may be displaceable parallel to the axis of rotation of the winding body, the inner thread driver being arranged on a linear guide in the winding body surface and the outer thread driver being arranged on an outer ring which is drivable in rotation and surrounds the winding body and which is mounted in an outer-ring bearing.

The device may have an inner thread driver, arranged on the winding body, for picking up and driving all the strip threads to be wound at the lap start, and also an outer thread driver, corotating on its outer path of rotation synchronously with the winding body, for temporarily picking up all the threads of a wound strip.

Figure 4:
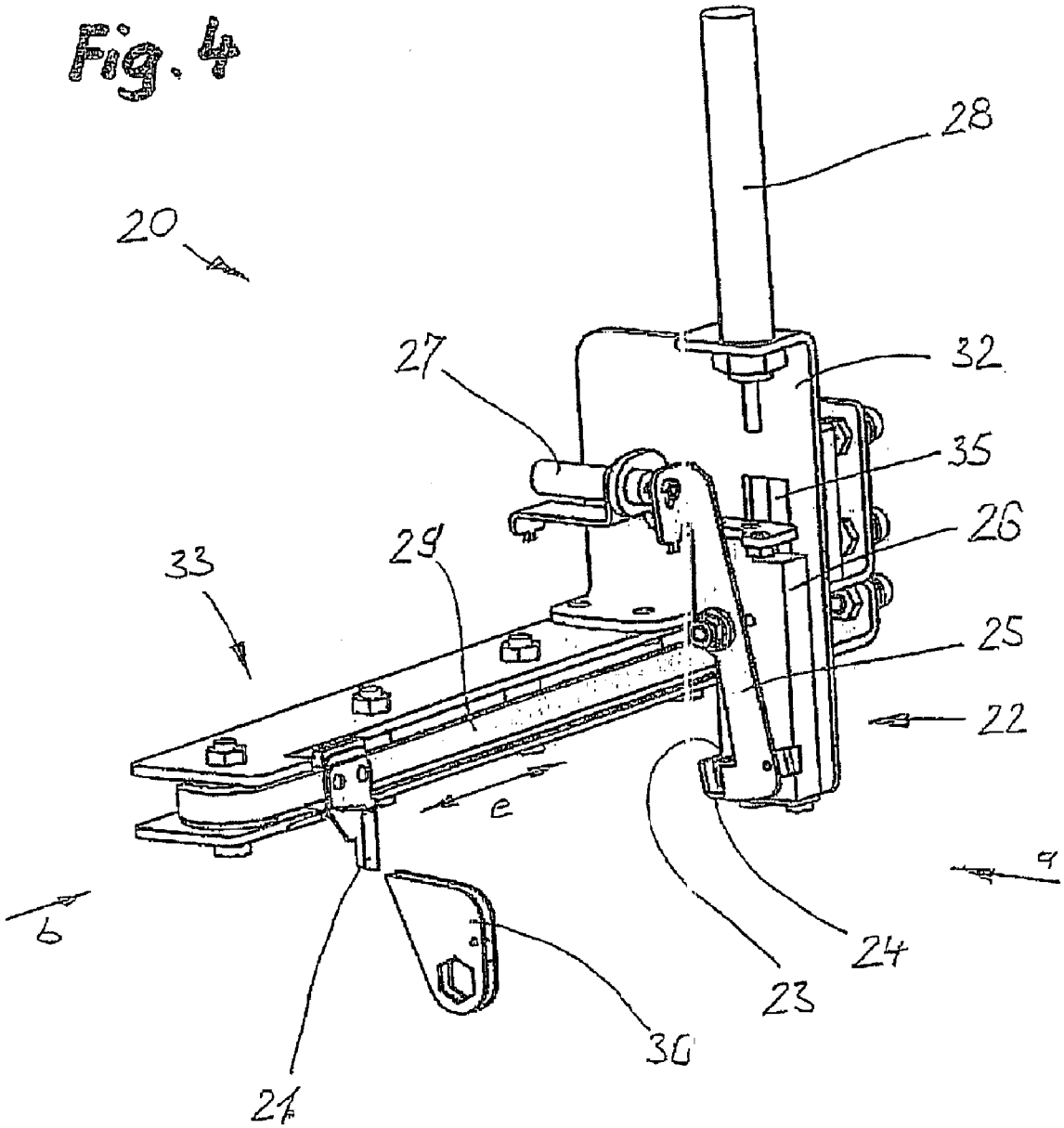
Figure 5:
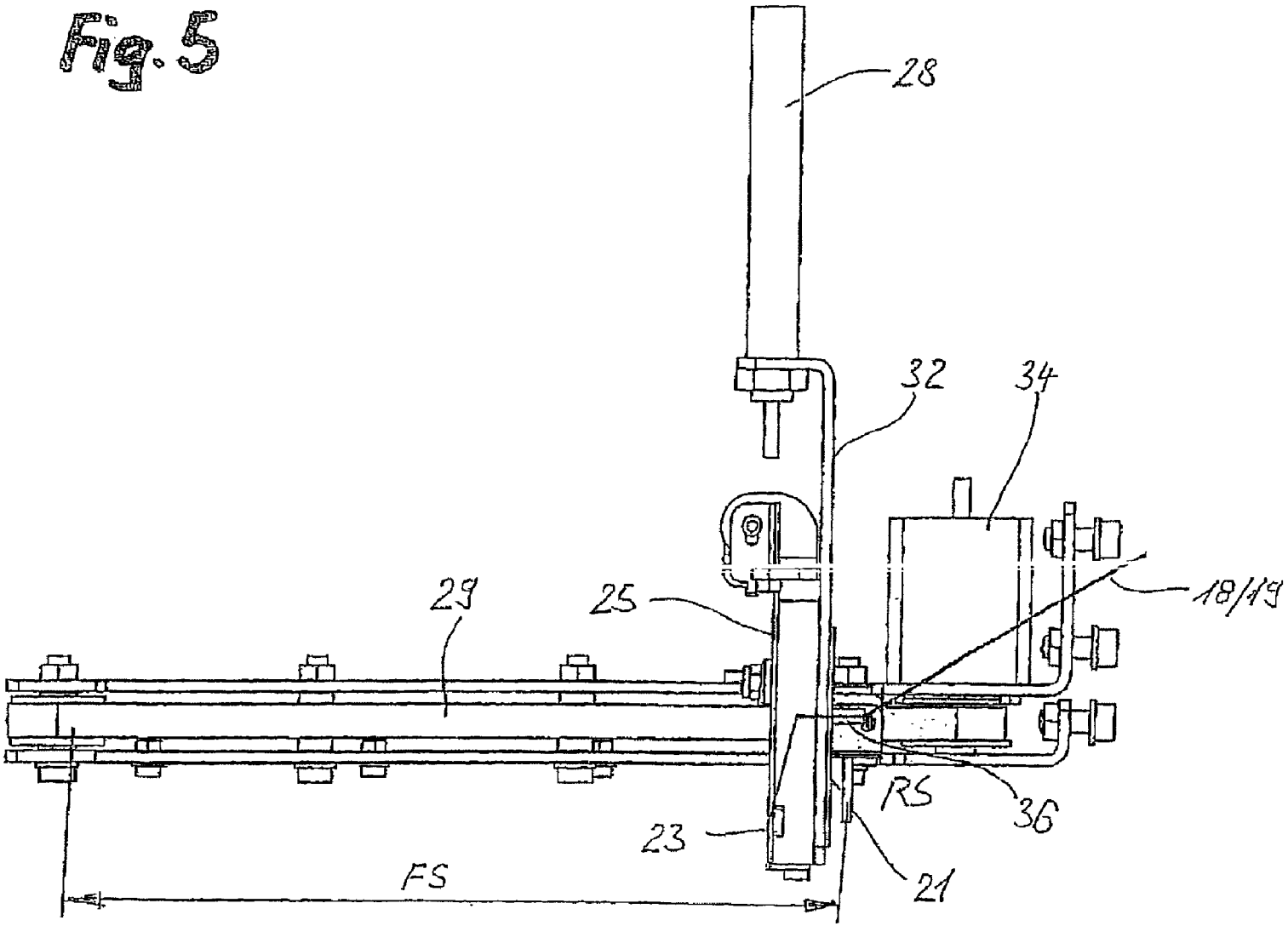
Figure 6:
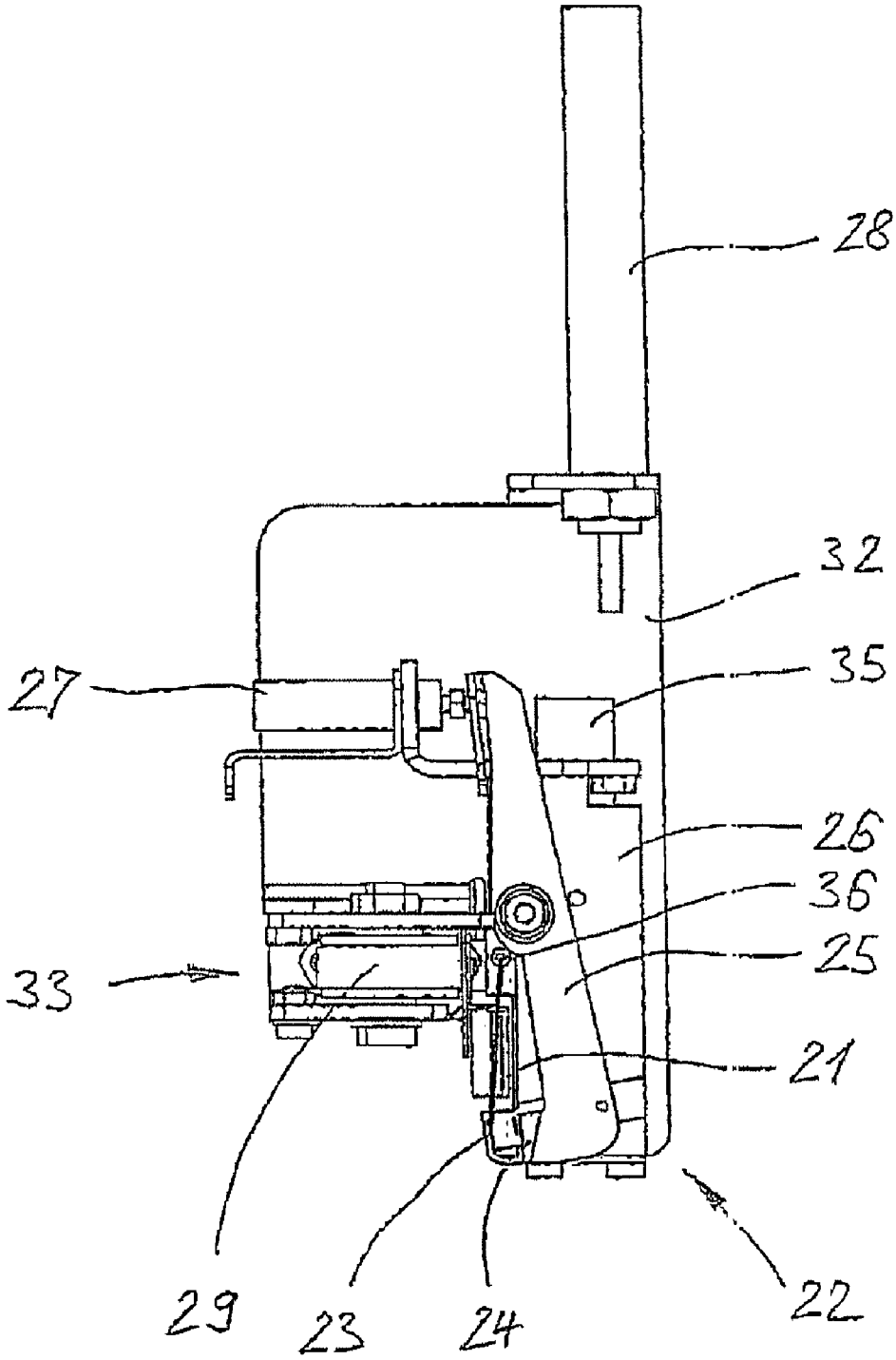
Figure 7B:
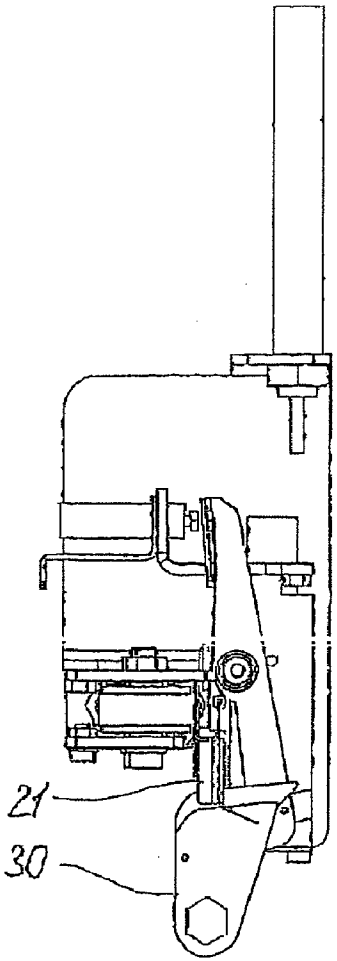
Figure 7A:
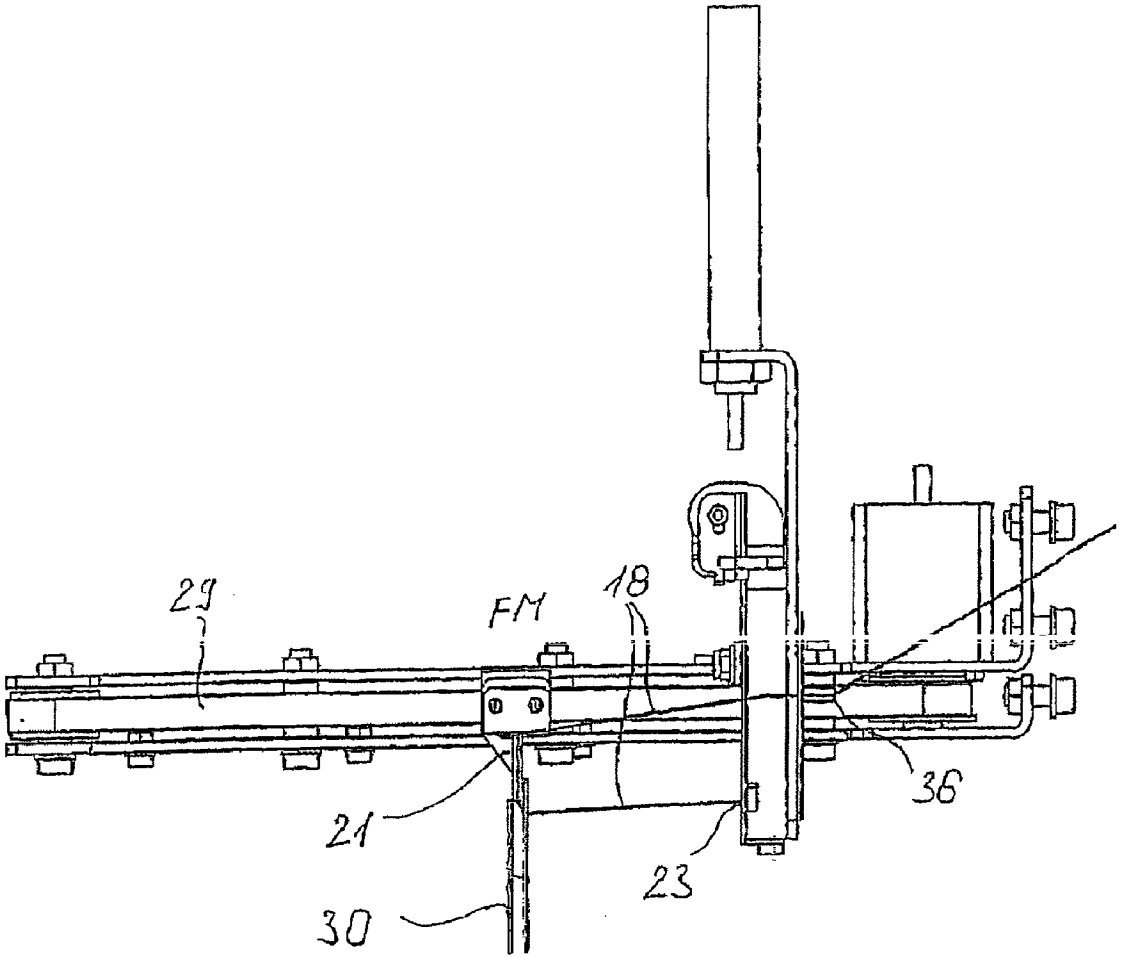
Figure 8B:
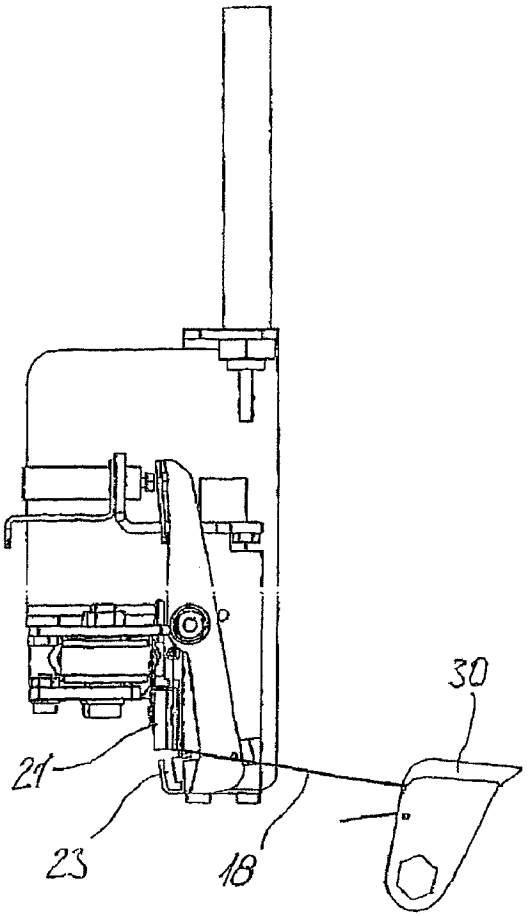
Figure 8A:
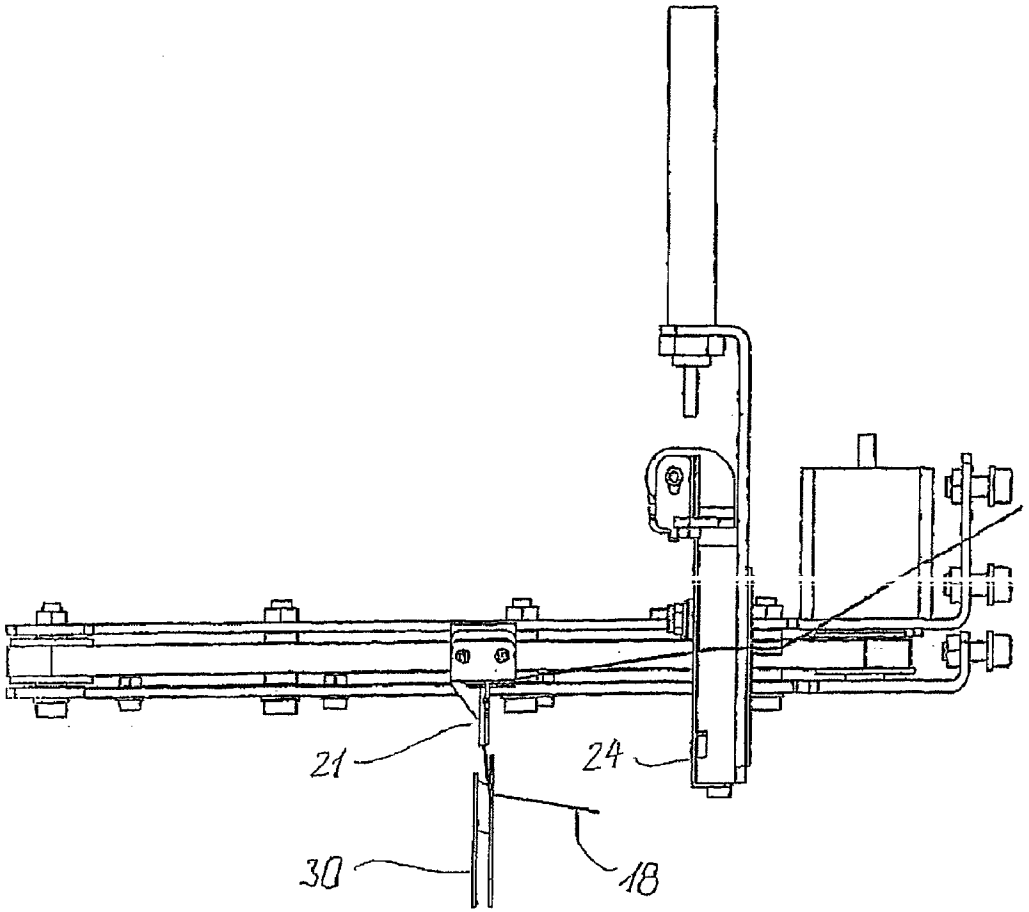
Figure 9B:
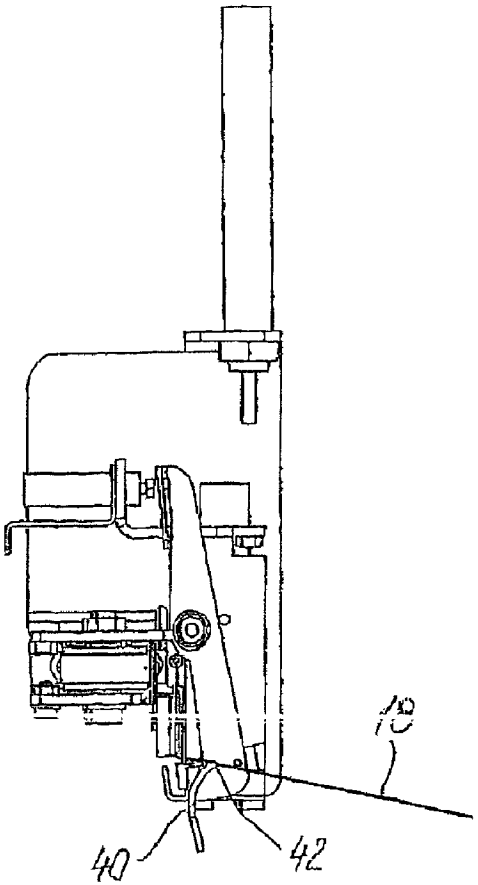
Figure 9A:
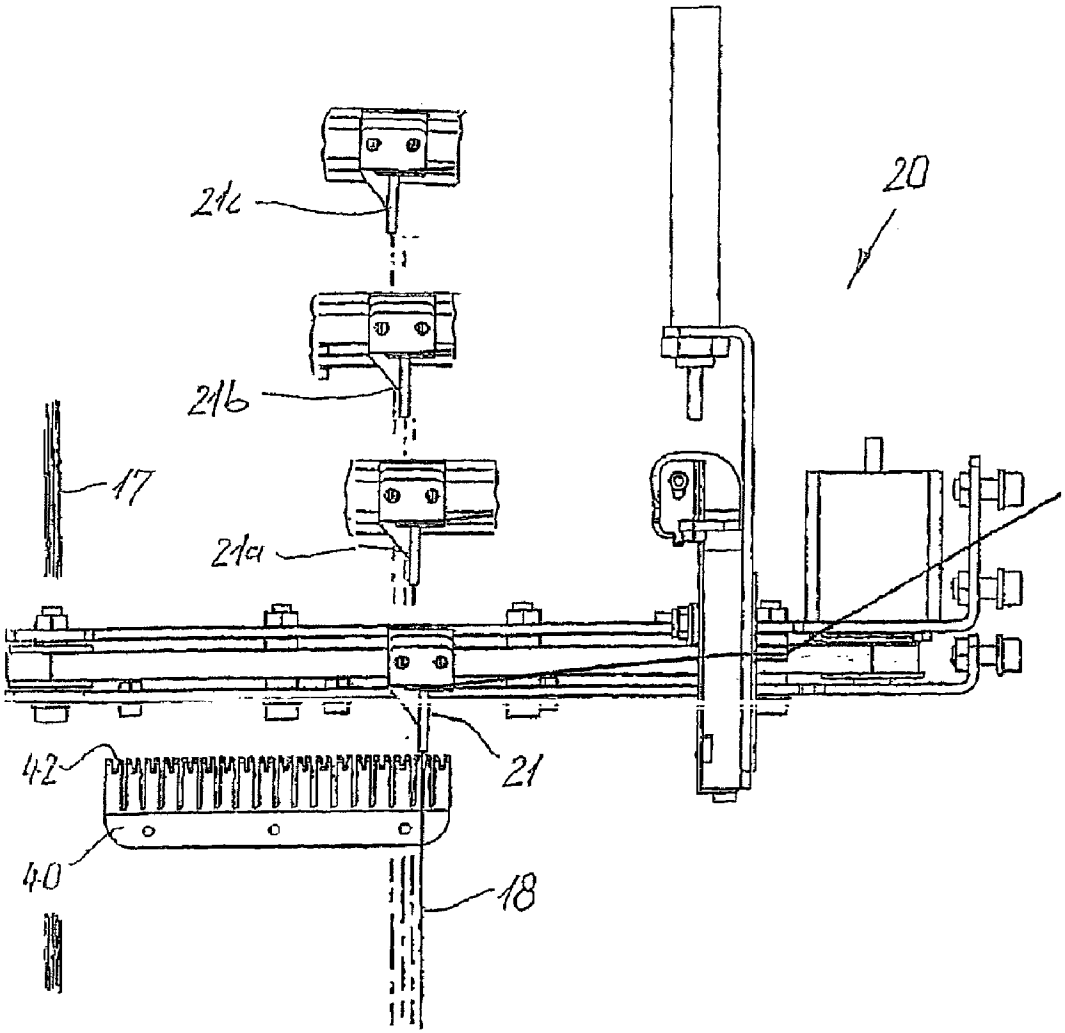
Figure 10B:
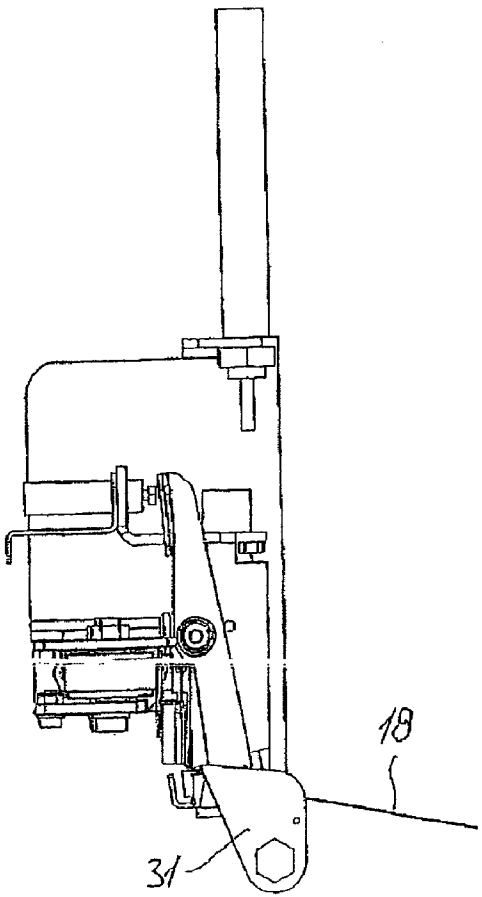
Figure 10A:
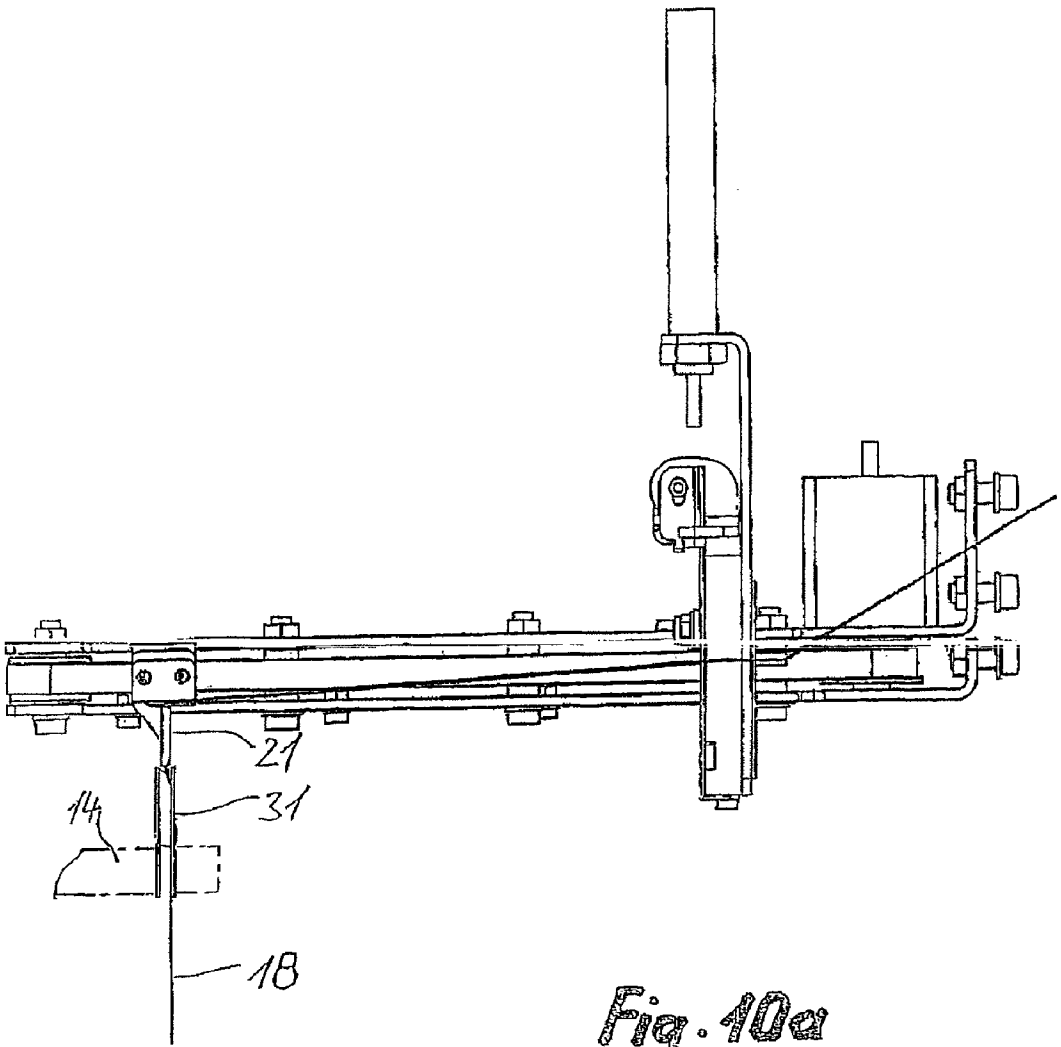
Figure 12:
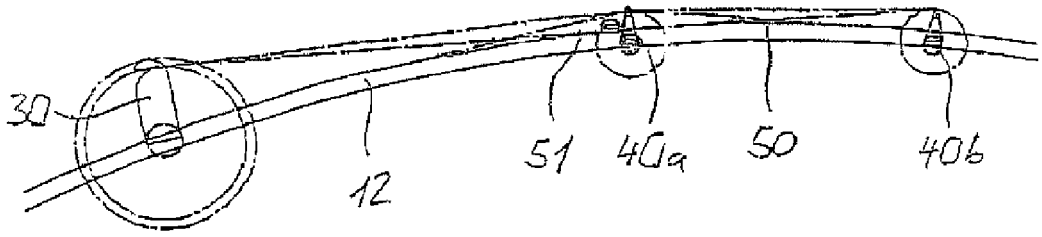
Figure 13:
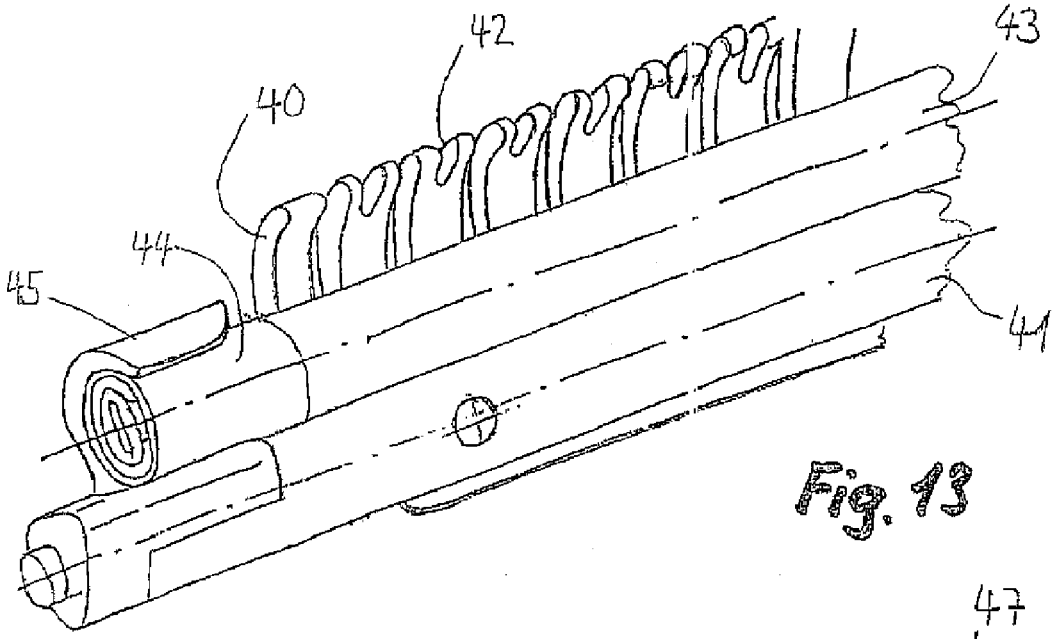
Figure 14:
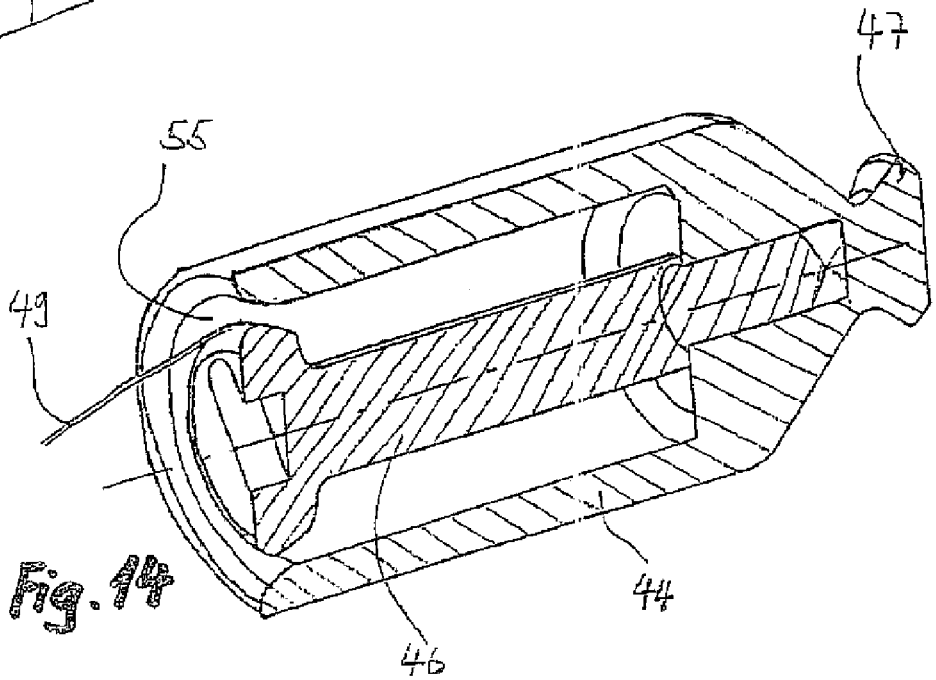
Figures 18, 19, 20:
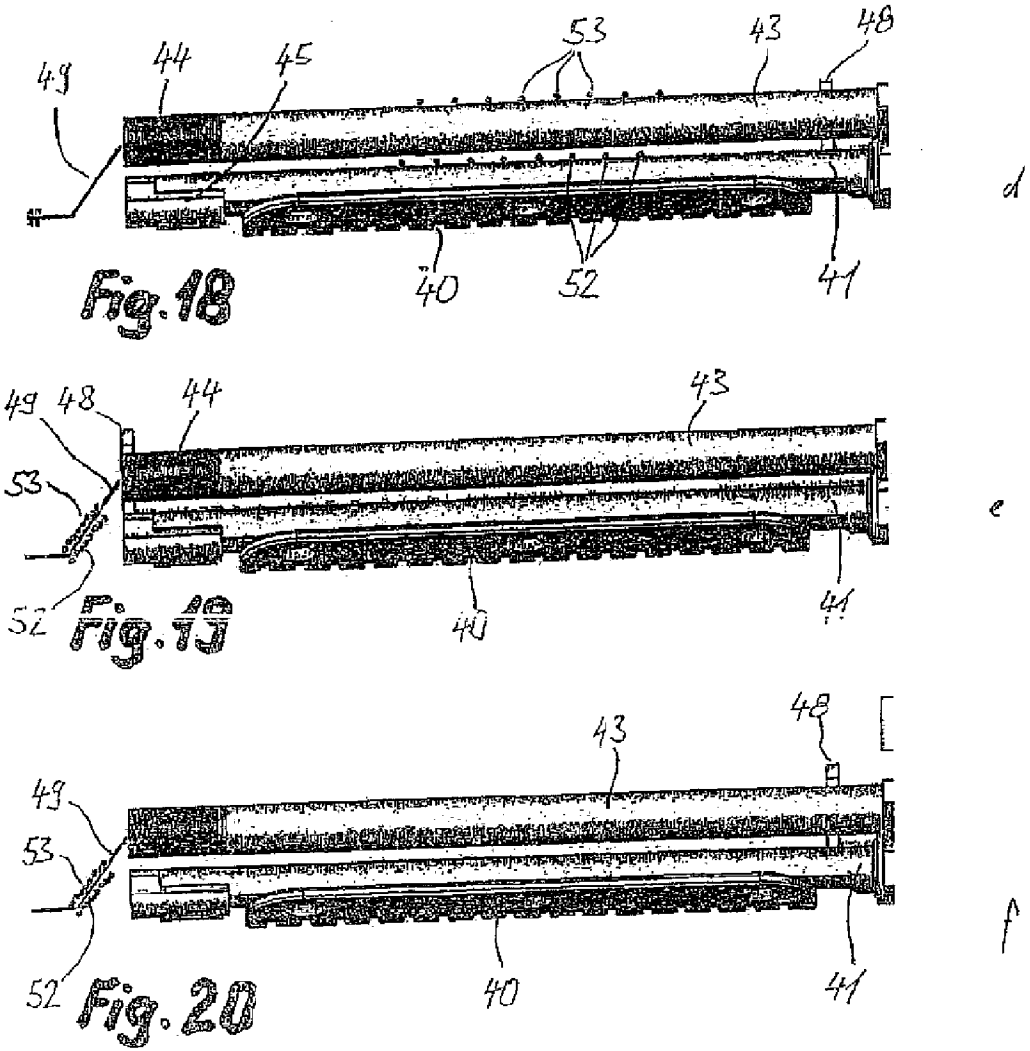
Figure 21A:
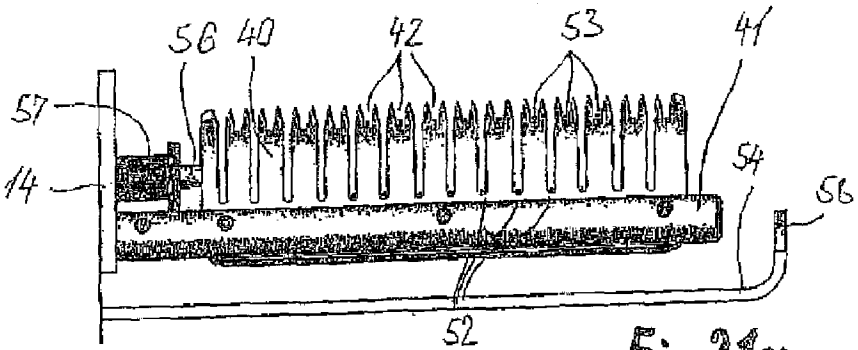
Figure 21B:
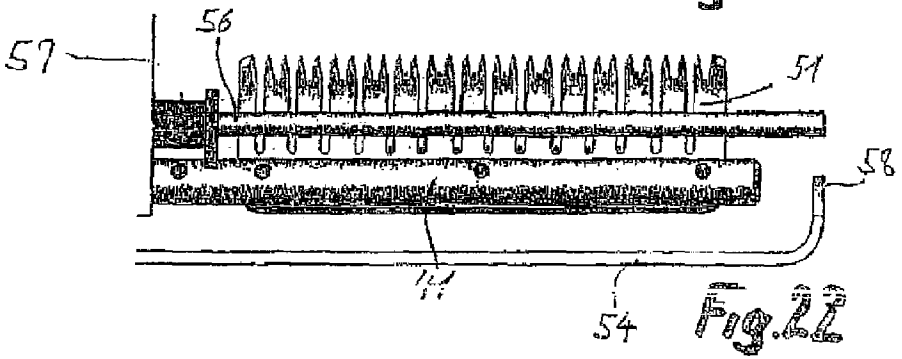
Figure 23:
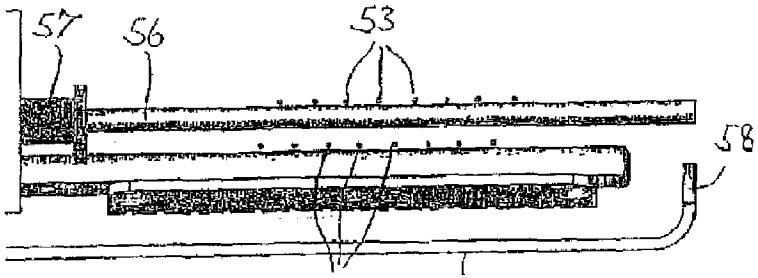
Figure 24B:
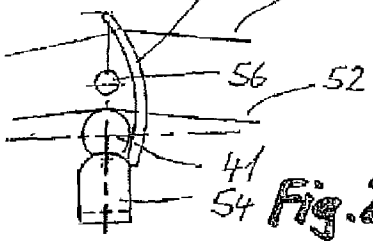
Figure 24:
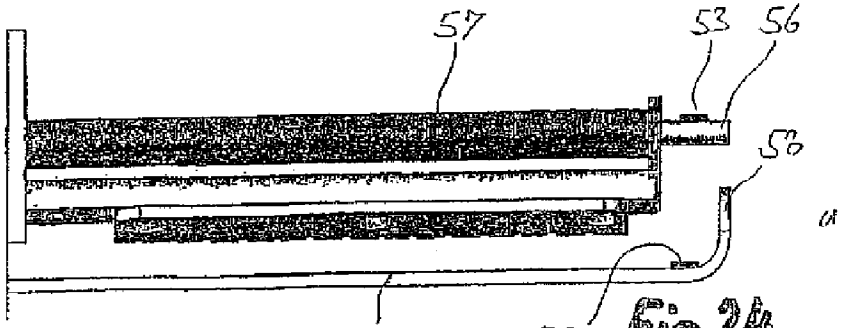
Figure 25:
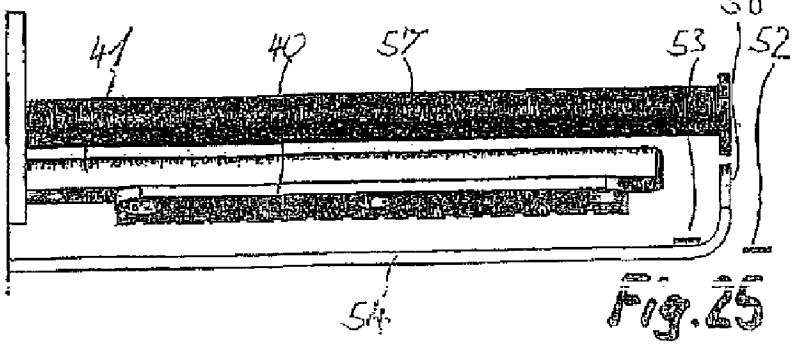
Figure 26:
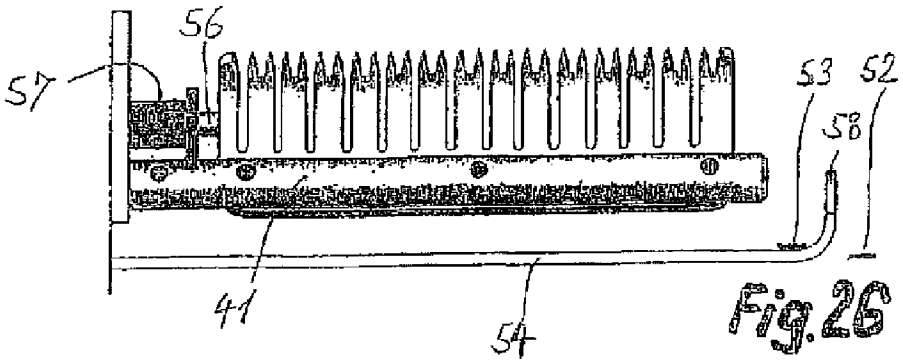
Figure 27:
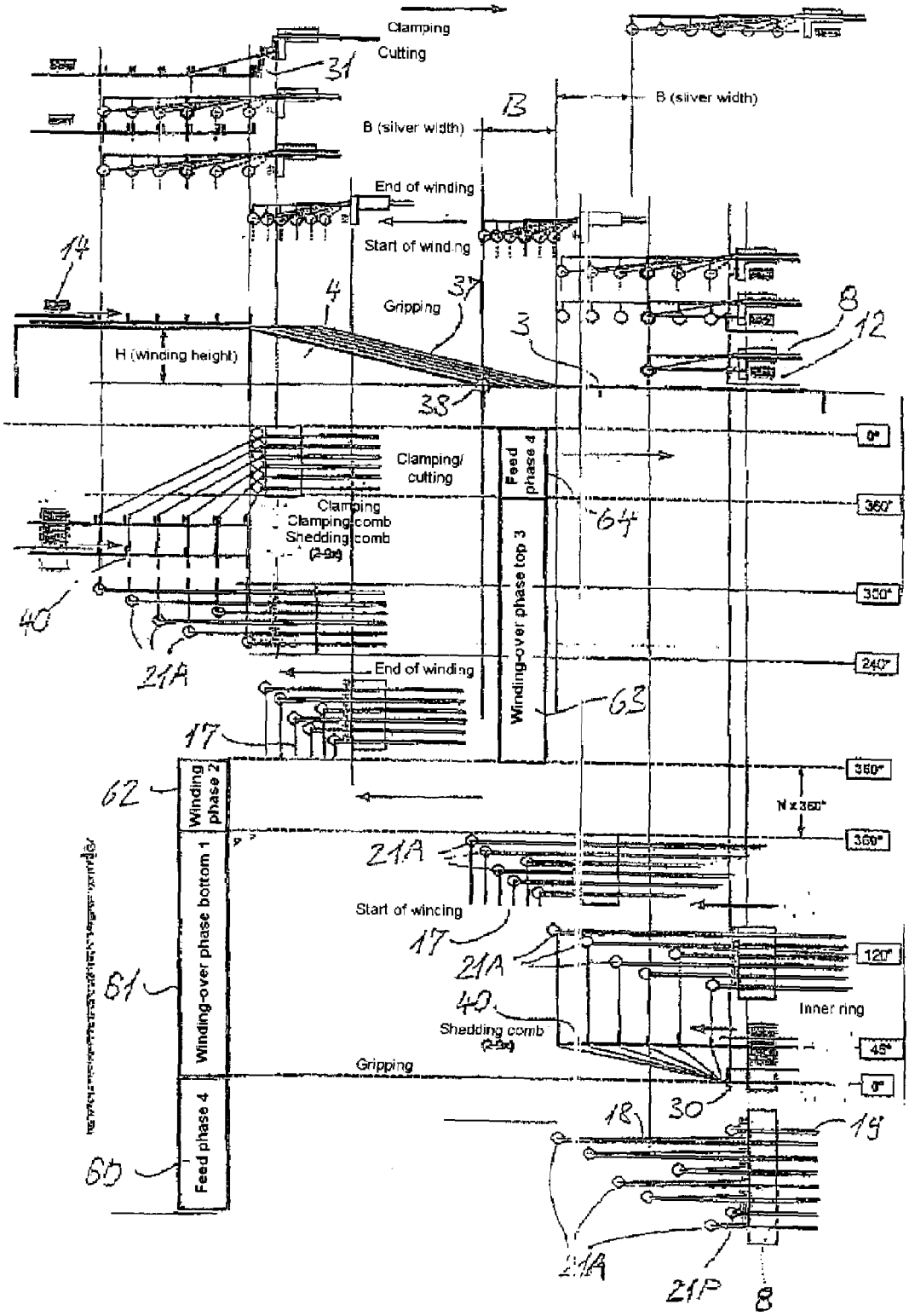
Figure 28A:
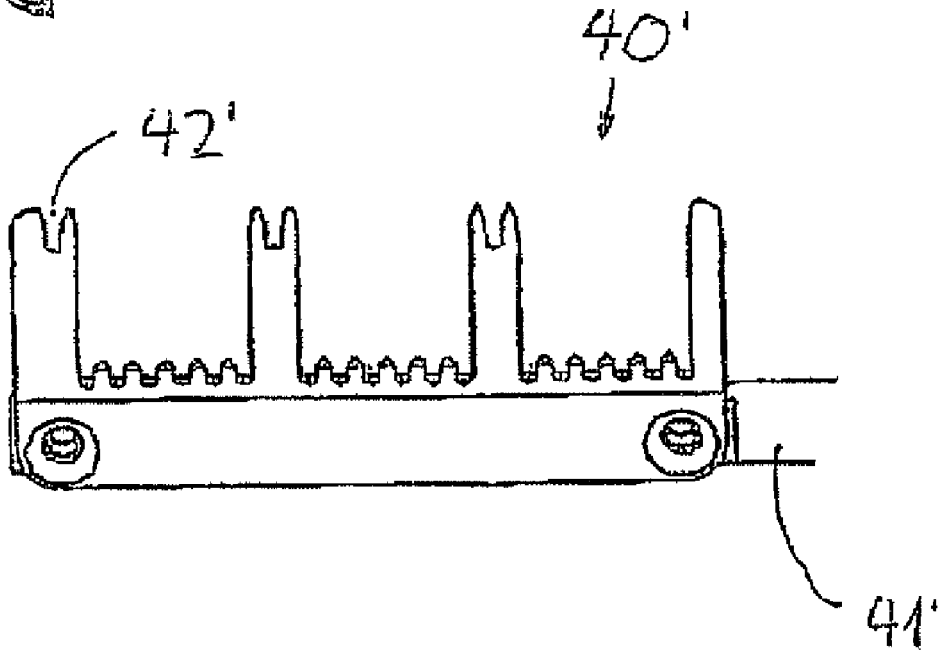
Figure 28B:
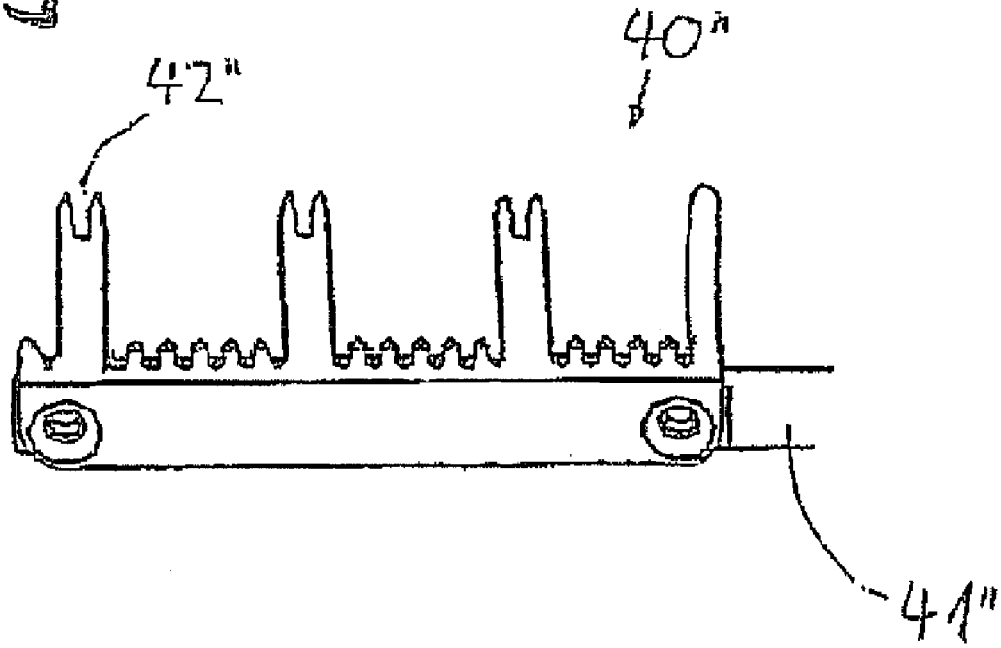
Figure 29A:
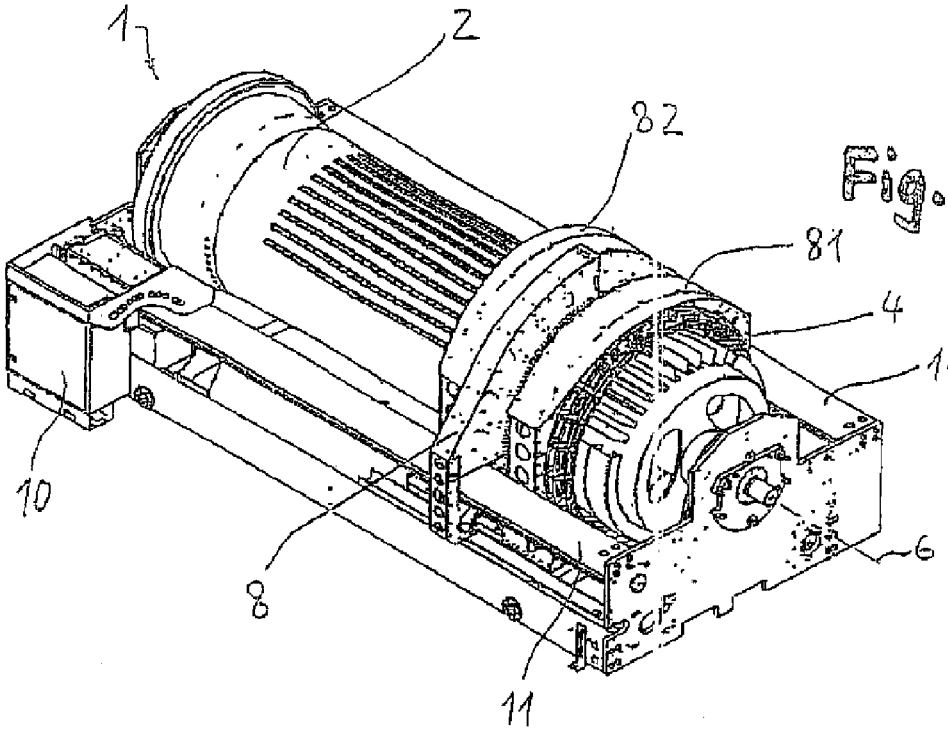
Figure 30:
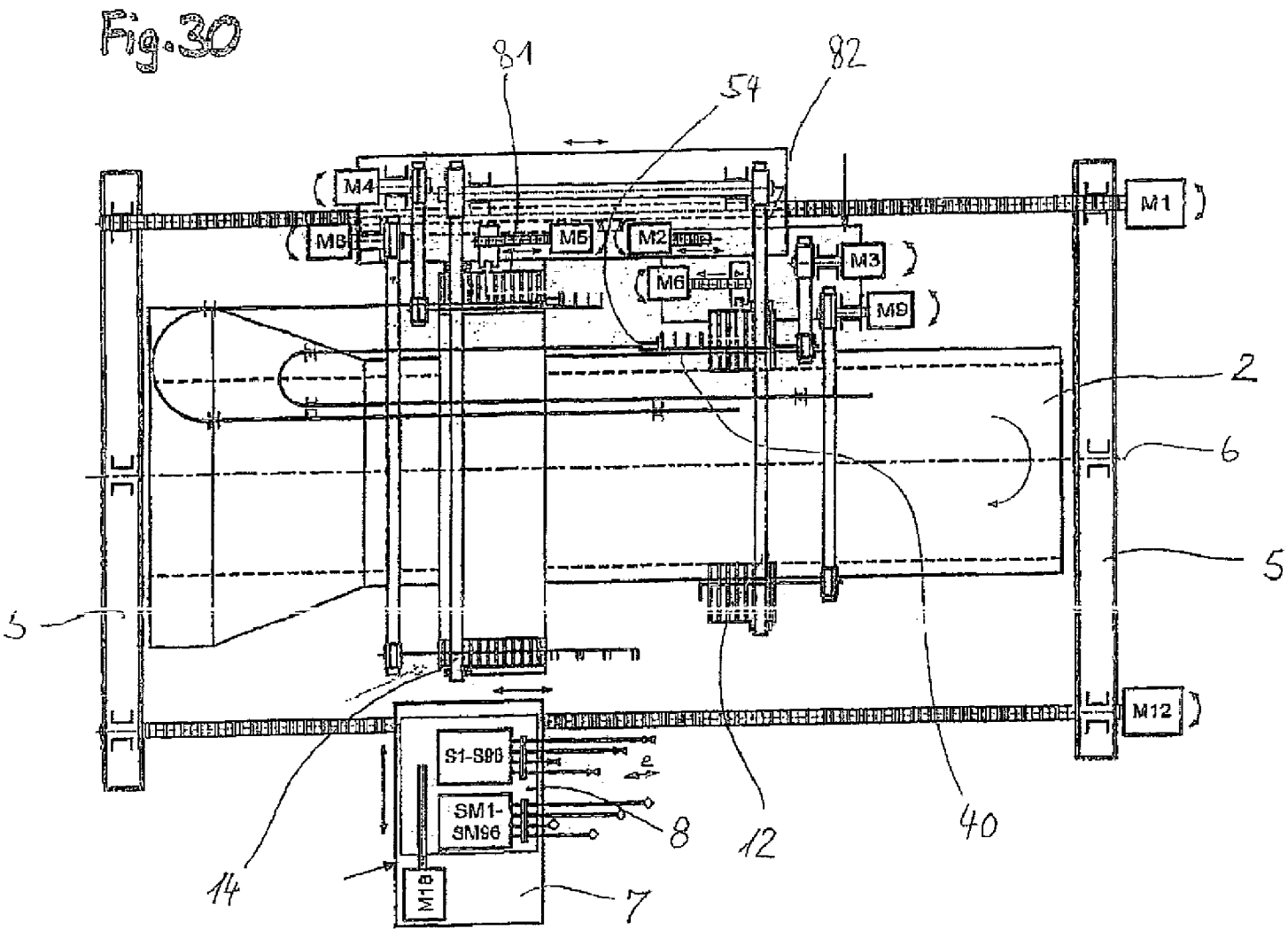
Figure 31:
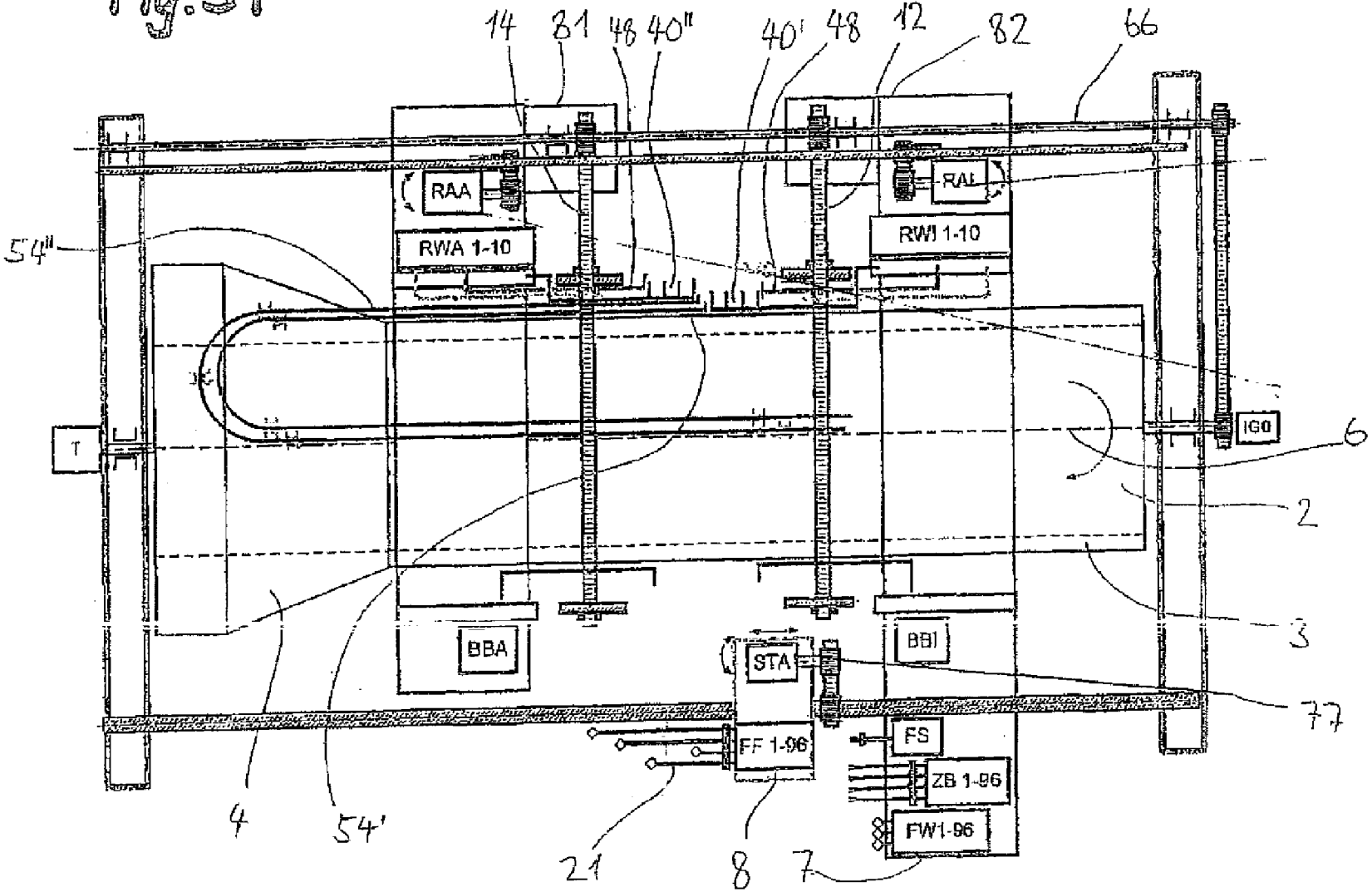
Figure 32:
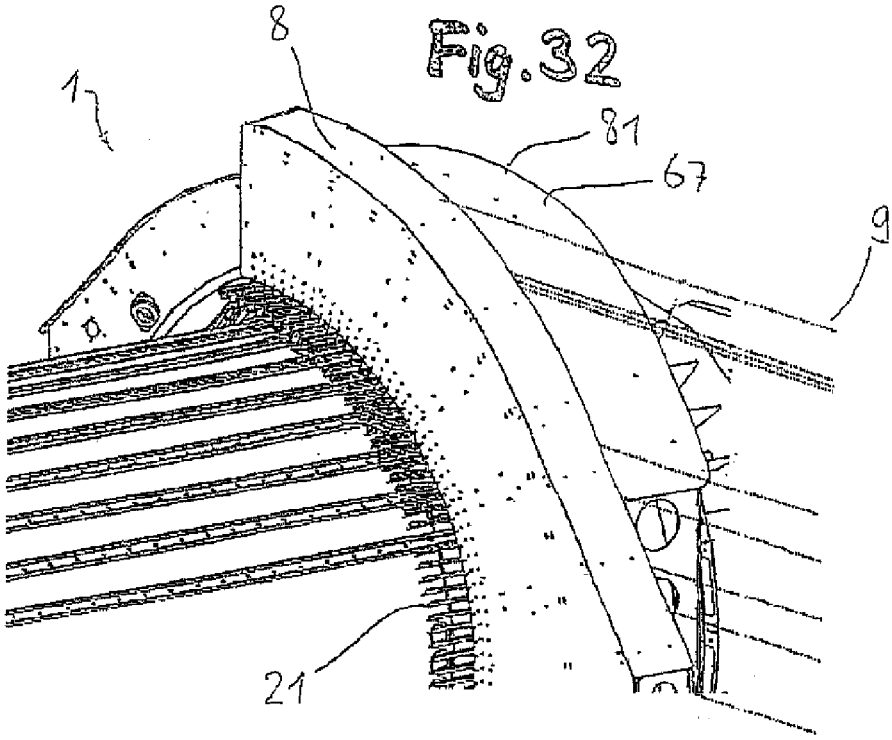
Figure 33:
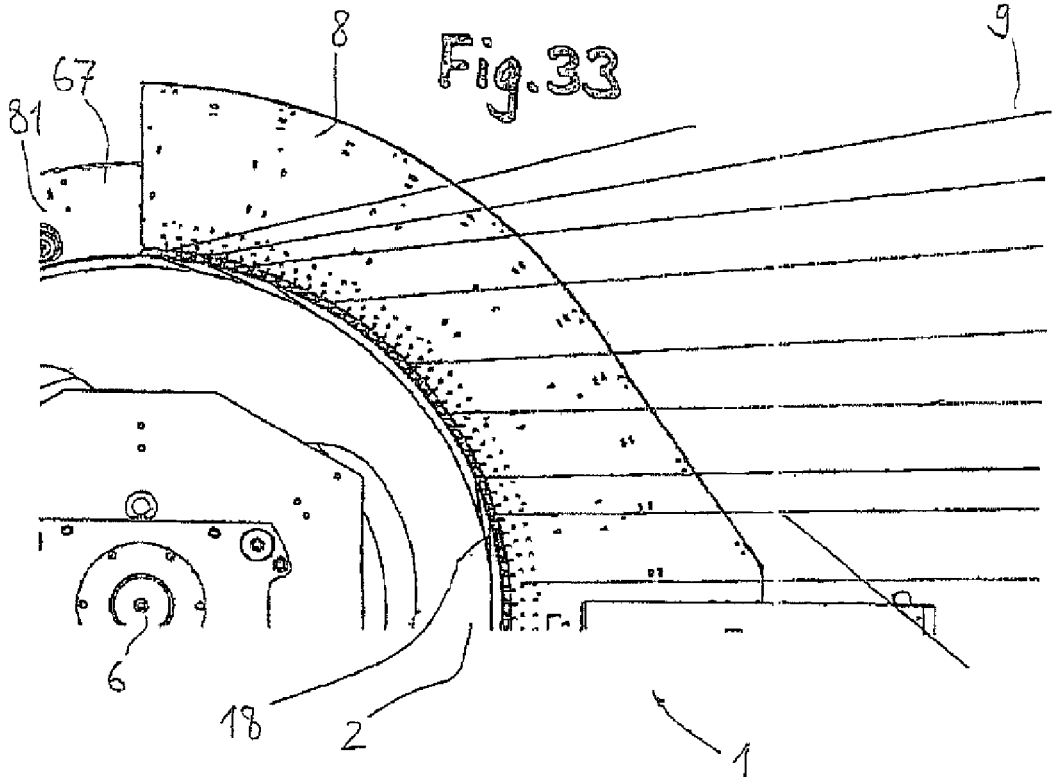
Figure 34:
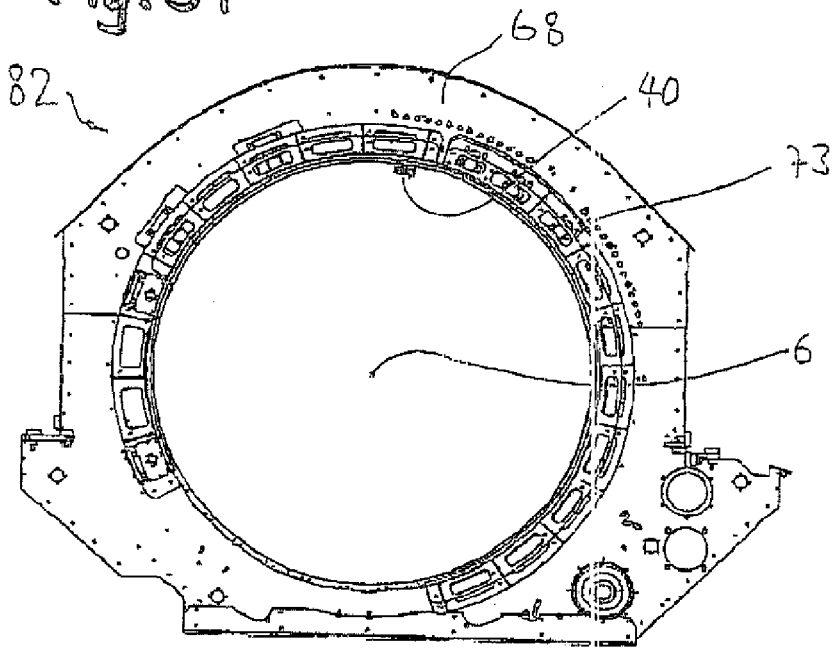
Figure 35:
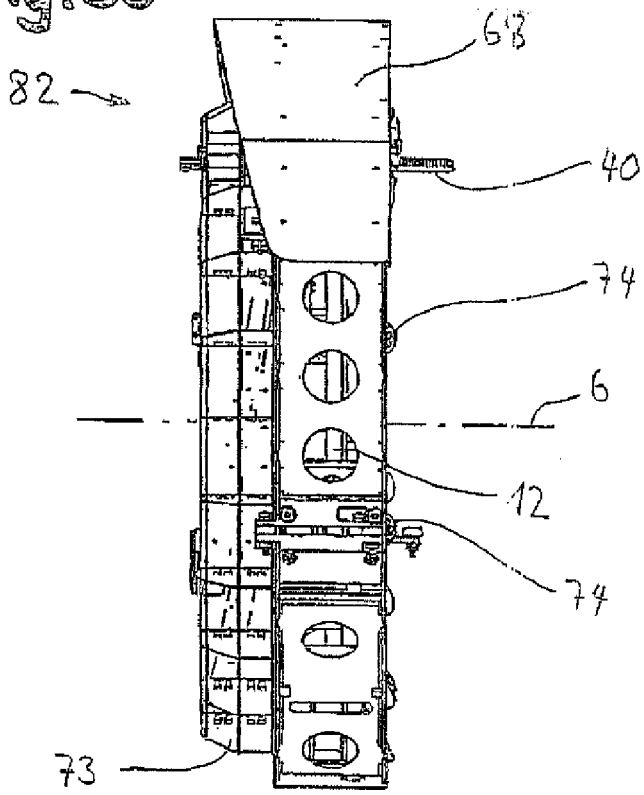
Figure 36:
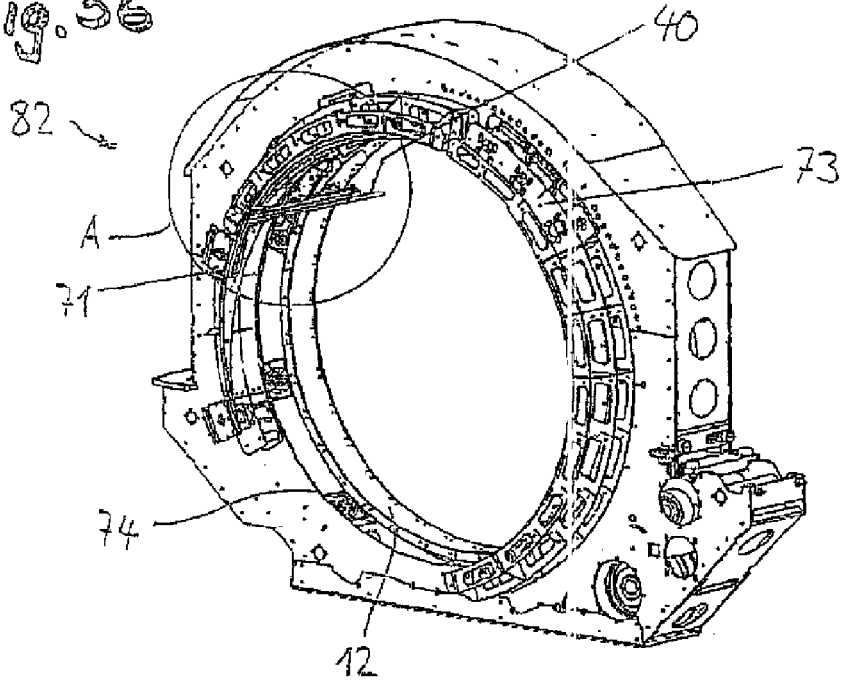
Figure 37:
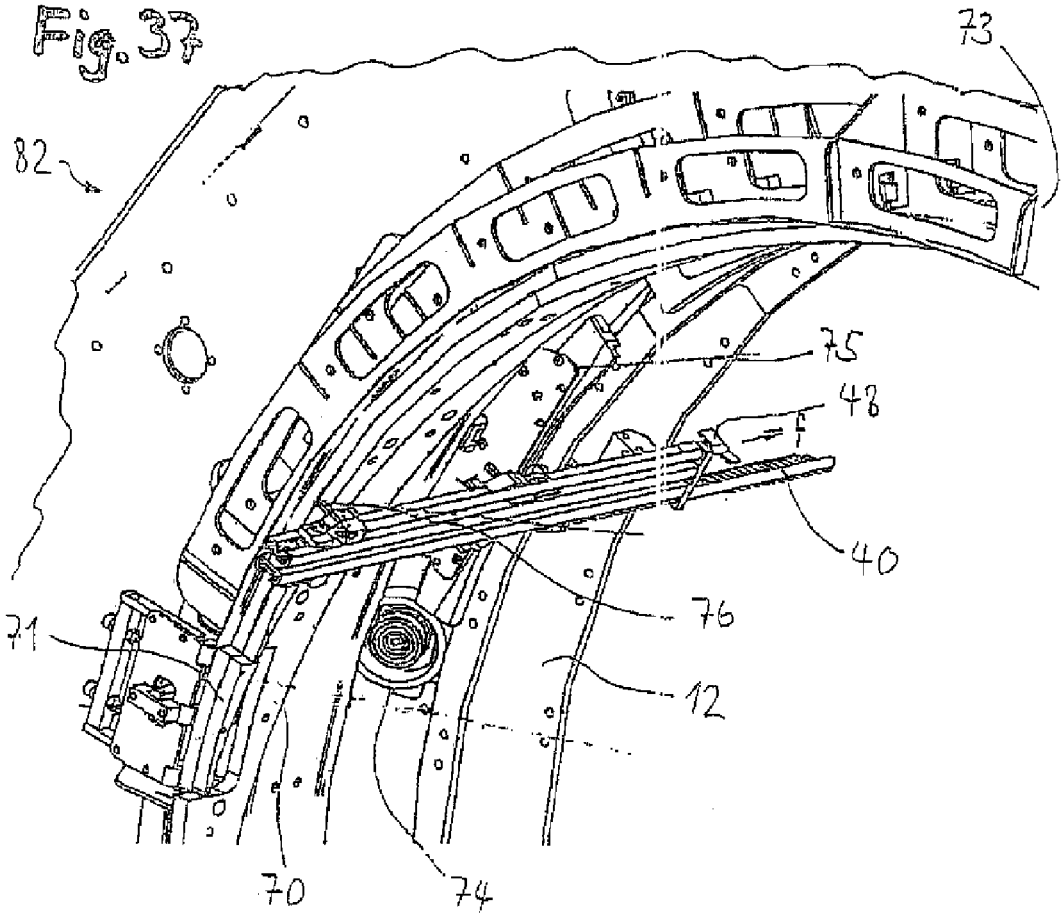
Figure 38:
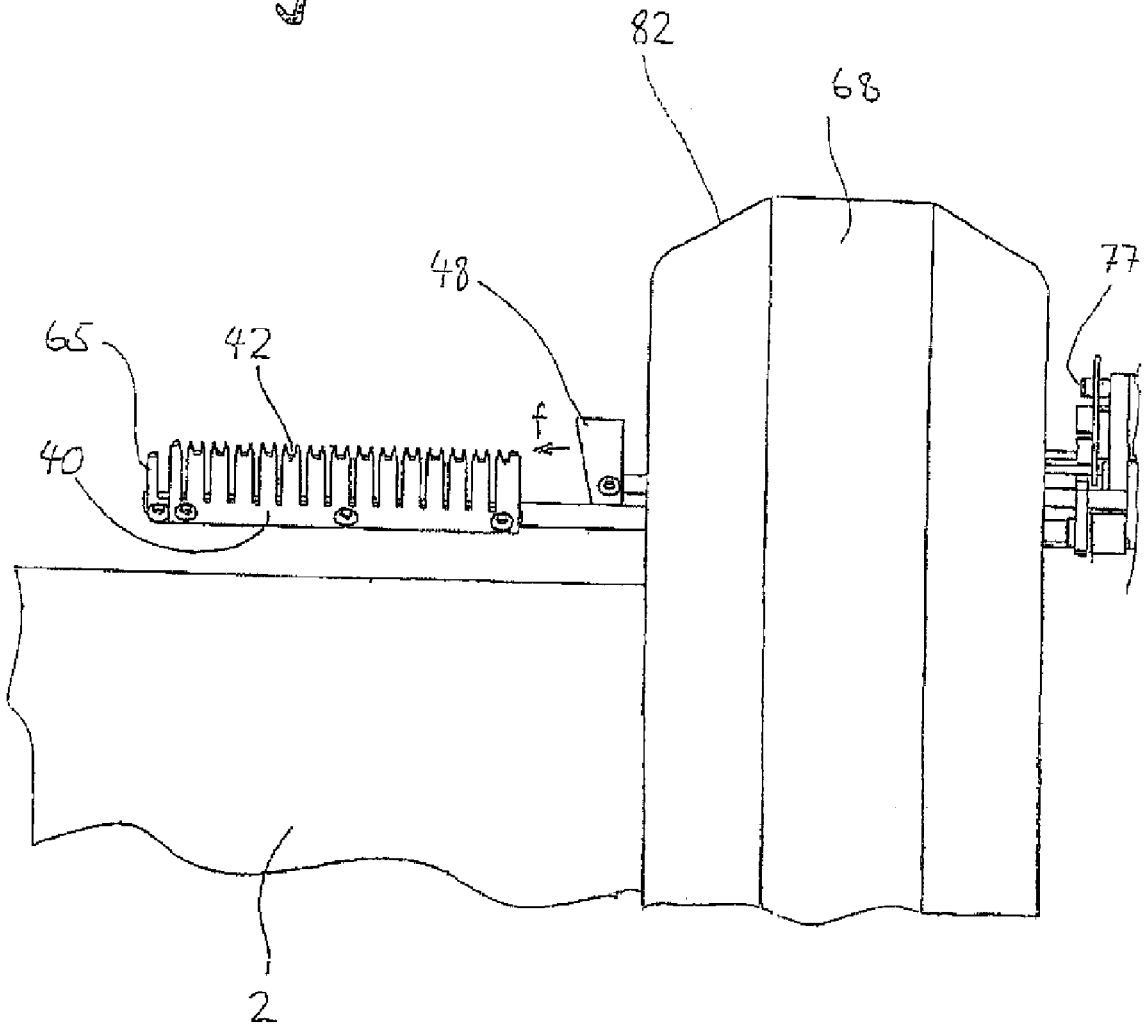
Figure 39A:
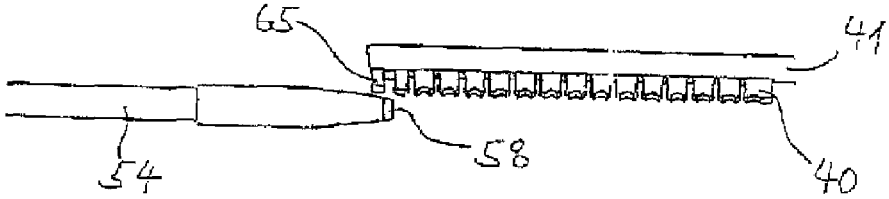
Figure 39B:
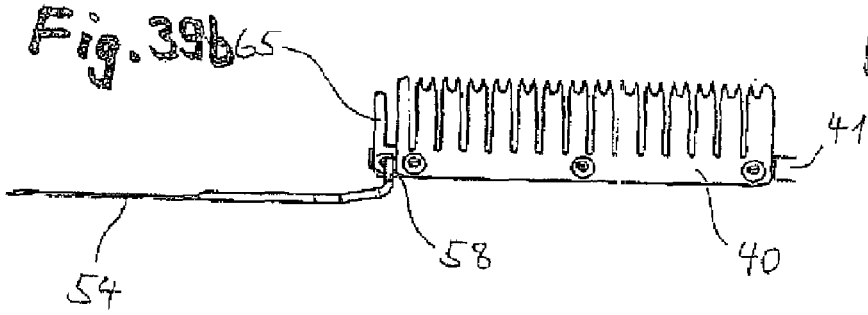
Figure 39C:
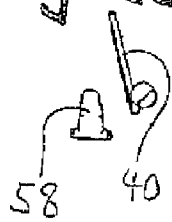
Figure 40A:
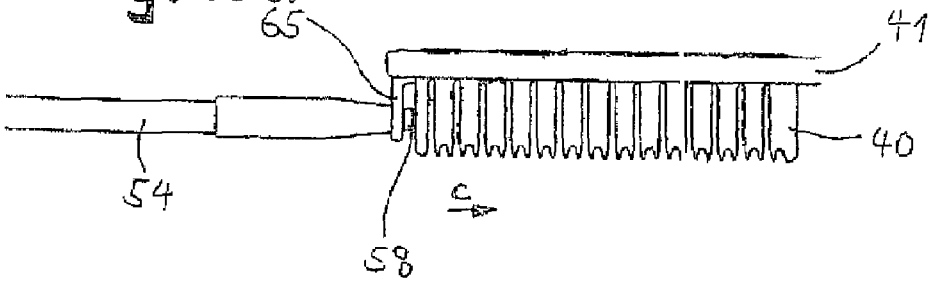
Figure 40B:
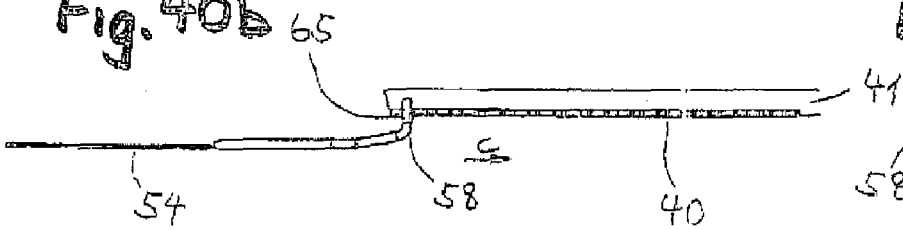
Figure 40C:
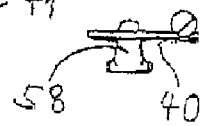
Figure 41A:
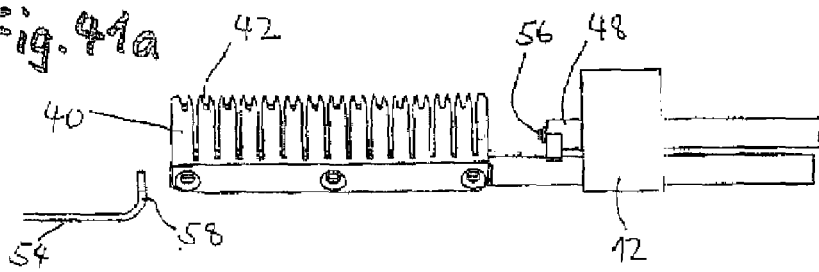
Figure 41B:
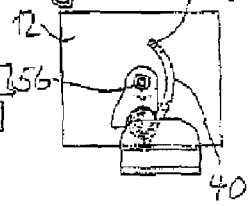
Figure 42A:
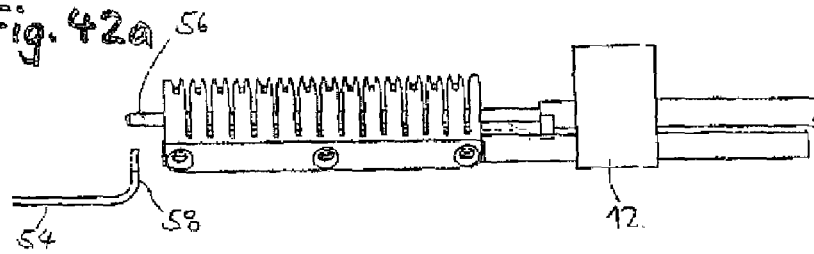
Figure 42B:
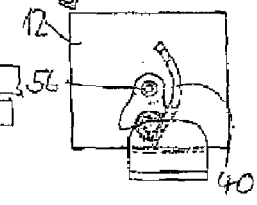
Figure 43A:
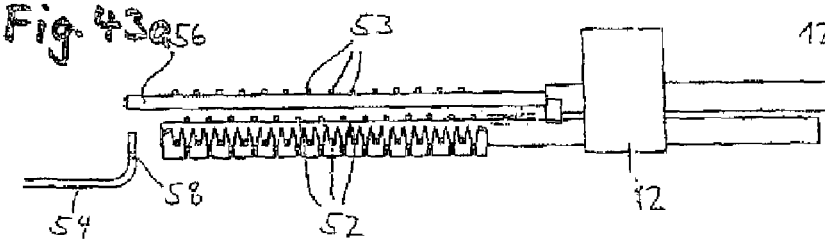
Figure 43B:
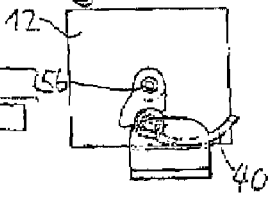
Figure 44A:
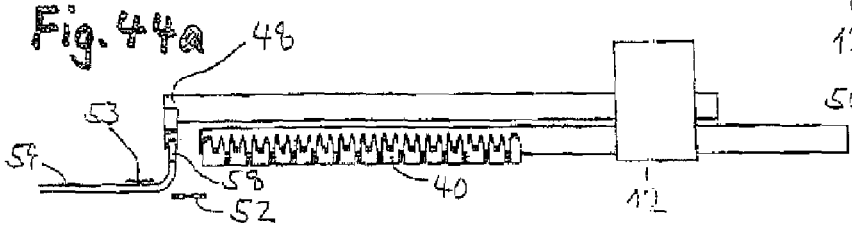
Figure 44B:
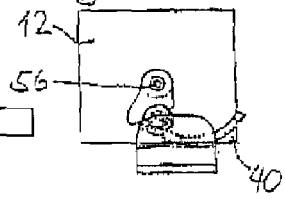

Further advantages and refinements of the invention may be gathered from the following description of an exemplary embodiment and from the drawings in which:

FIG. 1 shows a perspective overall illustration of a warping frame,

FIG. 2 shows a perspective part illustration of the warping frame according to FIG. 1 from another viewing angle, FIG. 3 shows a part view of a perspective illustration of a thread selection device with thread guide modules of a warping frame, FIG. 4 shows a perspective illustration of an individual thread guide module, FIG. 5 shows a view of the thread guide module according to FIG. 4 from the direction of the arrow (a), FIG. 6 shows a view of the thread guide module according to FIG. 4 from the direction of the arrow (b), FIGS. 7*a*/7*b* show the thread guide module in the thread transfer position, FIGS. 8*a*/8*b* show the thread guide module immediately after the separation of the thread by the clamping point, FIGS. 9*a*/9*b* show the thread guide module when the thread is being deposited on a shedding comb, FIGS. 10*a*/10*b* show the thread guide module at the lap end during the take-over of the thread by the outer thread driver, FIGS. 11*a*/11*b* show the thread guide module during the separation of the working thread at the lap end, FIG. 12 shows a highly diagrammatic side view of a lease, FIG. 13 shows a perspective illustration of the end of a shedding comb on the winding body with an introduced auxiliary crossing rod, FIG. 14 shows a dividing cord sleeve illustrated in section and in perspective, FIGS. 15*a*/15*b* show a lower shedding comb for leasing in the operating position before the reading in of the threads, FIG. 16 shows the shedding comb with inserted threads, FIG. 17 shows the shedding comb with a moved-out auxiliary crossing rod, FIG. 18 shows the shedding comb in the position of rest with a dividing cord sleeve coupled to the auxiliary crossing rod end, FIG. 19 shows the shedding comb with pushed-forward thread stripper, FIG. 20 shows the shedding comb with drawn- back thread stripper, FIGS. 21*a*/21*b* show an upper shedding comb with leased threads, FIG. 22 shows the shedding comb after the introducing of an auxiliary crossing rod, FIG. 23 shows the pivoted-back shedding comb with upper threads deposited onto the auxiliary crossing rod, FIG. 24 shows the shedding comb after the stripping of the lower threads onto a dividing band, FIG. 25 shows the shedding comb after the stripping of the upper threads onto the lap, FIG. 26 shows the shedding comb in a neutral initial position for receiving a new strip, FIG. 27 shows a diagrammatic illustration of winding and leasing on a strip lap, FIG. 28*a* shows a first shedding comb for size distribution, FIG. 28*b* shows a second shedding comb for size distribution, FIGS. 29*a*/29*b* show a perspective overall illustration of a further warping frame, FIG. 30 shows a top view of a diagrammatic warping frame with an illustration of the individual frame components, FIG. 31 shows a further diagrammatic illustration of a warping frame, FIG. 32 shows a detail of a perspective illustration of the warping frame according to FIGS. 29*a*/29*b* with a thread selection device and with a device for thread distribution, FIG. 33 shows a front view of the detail according to FIG. 32 during a warping operation, FIG. 34 shows a front view of the thread distribution unit of the warping frame according to FIGS. 29*a*/29*b*, FIG. 35 shows the thread distribution unit according to FIG. 35 in a side view, FIG. 36 shows the thread distribution unit according to FIG. 34 in a perspective illustration, FIG. 37 shows a detail of the thread distribution unit according to FIG. 36 (detail A), FIG. 38 shows a side view of a thread distribution unit, FIGS. 39*a*-39*c* show a shedding comb in a shedding position and a dividing band, FIGS. 40*a*-40*c* show the shedding comb according to FIGS. 39*a*/39*b*/39*c* in a position of rest and the dividing band, FIGS. 41*a*/41*b* show a lower or inner shedding comb with leased threads, FIGS. 42*a*/42*b* show the shedding comb after an introduction of an auxiliary crossing rod, FIGS. 43*a*/43*b* show the pivoted-back shedding comb with upper threads deposited onto the auxiliary crossing rod, and FIGS. 44*a*/44*b* show the shedding comb after the stripping of the upper and lower threads onto the lap.

As is evident from FIGS. 1 and 2, a warping frame, designated as a whole by 1, consists essentially of a warping drum 2 as a winding body with a cylindrical portion 3 and with a conical portion 4. The warping drum is mounted in a stand 5 rotatably about a winding body axis or drum axis 6. A warping table 7 rests on a warping table guide 11 and is displaceable on the latter parallel to the axis of rotation 6 in the direction of the arrow c. On the warping table 7 is arranged a thread selection device 8 which is displaceable in relation to the warping drum and at right angles to the axis of rotation of the latter, this time in the direction of the arrow d.

The thread selection device curves over a segment of, for example, 90° about the surface of the warping drum 2. A multiplicity of thread guide modules 20, illustrated merely diagrammatically here, are arranged on the thread selection device closely one after the other in the circumferential direction. A thread group 9 is taken off from a bobbin creel, not illustrated in any more detail here, or from another thread dispenser device, each individual thread being led to one of the thread guide modules 20. Suitable devices, such as, for example, thread brakes, ensure that the threads always remain tensioned.

For shedding in order to produce leases or for size distribution at the start of a lap, an inner ring 12 is arranged on the cylindrical portion 3 of the warping drum 2, carries the means for leasing or for size distribution and rotates together with the drum. The inner ring 12 is guided in drum longitudinal grooves 13 and can be displaced along these in the same way as the warping table 7 in the direction of the arrow c.

For shedding, in particular for leasing at the end of a lap, an outer ring 14 is provided, which concentrically surrounds the drum casing and which can be driven synchronously with the drum. The outer ring is mounted in an outer-ring bearing 15 which, in turn, is supported on an outer-ring slide 16 and is displaceable linearly on the latter in the direction of the arrow c. The outer ring 14 also carries the means required for leasing.

The components for controlling the warping frame are accommodated in a control cabinet 10.

FIG. 3 shows the perspective part view of the thread selection device with thread guide modules of a warping frame. The thread selection device 8 has a plurality of thread guide modules, the modules 20', 20", 20'" and 20'$^{IV}$ being arranged one after the other in the circumferential direction. In FIG. 3, a shedding comb 40 assigned to an inner ring can also be seen, the configuration and functioning of which are described in detail later. A thread guide 21 can be displaced to and fro or positioned along the drum axis in the direction of the arrow e. The movement of the thread guide 21 may take place by means of a traction mechanism 33. Other means for moving the thread guide 21 may, of course, also be envisaged, such as, for example, pneumatic or hydraulic systems.

An individual thread guide module 20 is described in somewhat more detail below with reference to FIGS. 4 to 6. The module has a holding plate 32, to which a gear unit 33 and a clamping/cutting unit 22 are fastened. The gear unit has a traction mechanism with a toothed belt 29. The toothed belt can be driven via a thread drive guide 34 which is preferably a stepping motor. Fastened to one of the two parallel toothed belt strands is a thread guide 21 which can cover a thread guide distance FS in the direction of the arrow e. In the position of rest RS, the thread guide 21 is set back behind the clamping/cutting unit. The clamping/cutting unit 22 is arranged on a lifting slide 26 which is mounted displaceably in a guide 35. The drive means is in this case a pneumatic pressure medium cylinder 28.

The clamping/cutting unit has a double lever arm 25 which is articulated on the lifting slide 26 and the upper lever arm of which can be activated via a pneumatic pressure medium cylinder 27. The actual cutting device 24 is formed on the lower lever arm by a cutting edge. Directly behind the cutting plane lies a clamping point 23 which can likewise be activated via the double lever arm 25.

The working thread supplied or stock thread 18/19 is introduced via a thread guide tube 36 which issues on the side of the double lever arm above the clamping point 23 in such a way that the thread lies on the thread guide distance of the thread guide 21. The thread guide has a notch or flute which prevents the thread from slipping away.

Figure 4B:
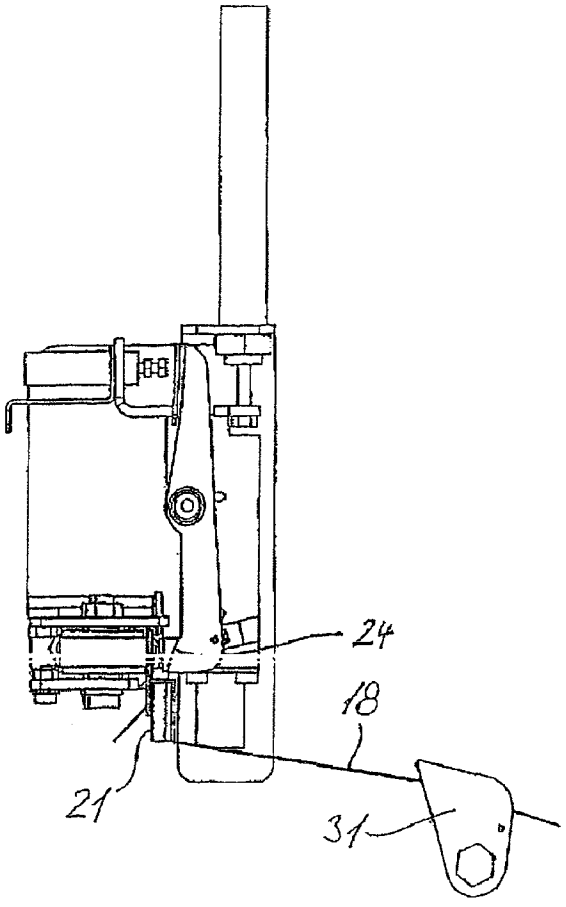
Figure 4A:
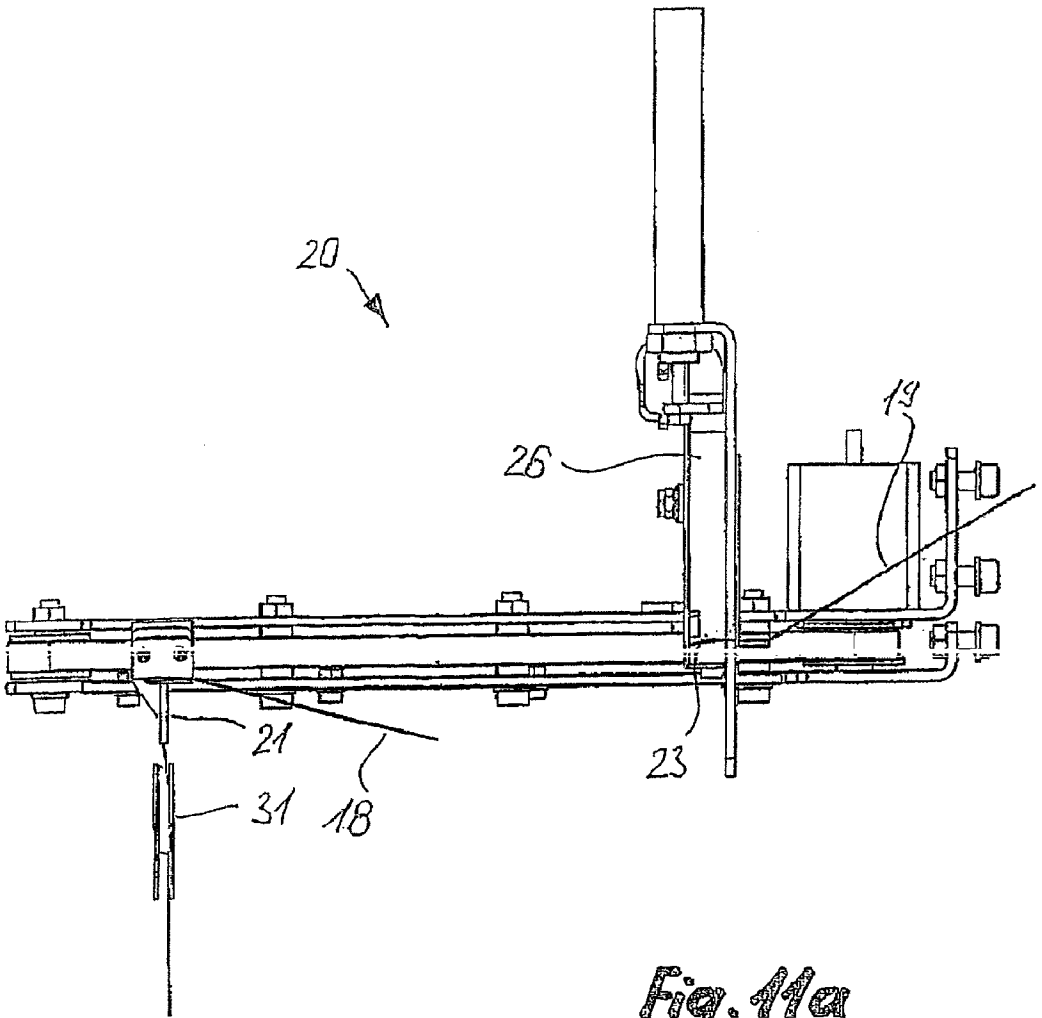

For a clearer understanding of the following description of the functioning of the thread guide module 20, the inner thread driver 30 assigned to the drum is also illustrated in FIG. 4*b*. This thread driver is capable, by means not illustrated in any more detail here, of clampingly picking up and carrying along a thread tensioned in the correct position.

As long as a thread is clamped to a thread guide module in the initial position illustrated in FIG. 5, it serves as a stock thread 19 which can be incorporated at any time as a working thread into the warping process in order to form a strip. For this purpose, according to FIGS. 7*a* and 7*b*, the thread guide 21 is activated so that it covers part of the thread guide distance FS and first occupies a thread driving position FM. The lifting slide 26 is in this case already in the lowered position illustrated in FIG. 5. The thread feed required for reaching the thread driving position FM is taken up via the thread guide tube 36. The rotational movement of the drum is coordinated with the movement of the thread guide 21 in such a way that, immediately after the thread driving position FM is reached, the lower thread driver 33 carries along this and any other working thread of the present lap.

Immediately after the thread has been picked up reliably, the clamping point 23 is released, so that the working thread is taken up at the circumferential speed of the inner thread driver 30. This situation is illustrated in FIGS. 8*a* and 8*b*. Up to this time point, all the active thread guide modules on the thread selection device operate simultaneously.

Thereafter, according to FIGS. 9*a* and 9*b*, the thread guide 21 is moved a little further on on the thread guide distance FS, in order to be leased into a shedding comb 40 for beating up a lease. This shedding operation is described in more detail later. The shedding comb for a lease has comb ends 42 which are forked in a U-shaped manner and in which an individual working thread can be deposited in each case. Threads can likewise be deposited between the individual comb ends 42. As illustrated symbolically in FIG. 9*a*, each thread guide 21*a*, 21*b*, 21*c*, etc. of thread guide modules following in the circumferential direction is then moved in order exactly to an extent such that a working thread is in each case deposited alternately on a comb end and between a comb end. After the beating up of the lease and after the introduction of a dividing element in the way described below, all the active thread guides 21, 21*a*, 21*b*, 21*c*, etc. move their respective working threads into the actual winding position of the strip 17, the width of which is obviously substantially smaller than the strip width during reading in onto the shedding comb 40. The thread guides 21 then maintain their relative position with respect to one another until the end of the lap is reached, the entire thread selection device being moved on the warping slide.

As soon as the end of a strip lap is reached and as soon as leases are also formed there by similar means, all the active thread guides 21 move once again into an outer thread driving position FM in which all the working threads 18 are transferred to an outer thread driver 31 or are carried along by the latter. This outer thread driver is an external outer ring 14 which concentrically surrounds the drum and corotates synchronously with the drum and which is illustrated merely symbolically in figures 10*a*/10*b*. This "gathering" of the threads takes place in order to prepare for the cutting operation which is illustrated in figures 11*a*/11*b*.

The lifting slide 26 is in this case moved on each thread guide module 20 into the upper end position, so that the clamping point 23 can pick up the taken-up thread. The cutting device 24 is activated virtually simultaneously, the working thread 18 just processed being freed from the thread guide 21 and being at the same time held again as a stock thread 19 in a position of readiness at the clamping point.

As is evident from FIG. 12, the means for beating up a lease at the start of a lap are arranged on the inner ring 12. The situation illustrated in FIG. 12 corresponds in this case approximately to that according to FIG. 9, threads which lie next to one another being alternately leased into shedding combs 40*a*, 40*b* arranged one behind the other. The inner thread driver is again indicated symbolically with 30. As a result of the alternate overwinding of the shedding combs, it is clear that a lease 50 is formed, with an open shed 51 into which a dividing element can be introduced. Of course, the beating up of a lease would also take place, in principle, in about the same way if synchronously corotating ring elements (outer ring, inner ring) surrounding the winding body were used. Size distribution may also take place in about the same way. In contrast to leasing, for size distribution a multiplicity of shedding combs arranged one behind the other must be provided. Furthermore, the shedding combs are designed differently for size distribution (see, in this respect, FIGS. 28*a* and 28*b*).

Further particulars of a shedding means are evident from FIGS. 13 and 14. The curved shedding comb 40, consisting, for example, of plastic, is fastened to a rotatable comb shank 41. An auxiliary crossing rod 43 is arranged displaceably parallel to the comb shank. At the end of the extended comb shank 41, a pincer-like sleeve mounting 45 is provided, which clampingly picks up a dividing cord sleeve 44. The approximately cylindrical dividing cord sleeve has a dividing cord spindle 46 which is screwed centrically into the dividing cord sleeve, so that an open annular gap 55 remains. On the dividing cord spindle 46 is wound a suitable dividing cord 49 which can be drawn off via the annular gap 55. The dividing cord sleeve 44 has, on the side facing the end face of the auxiliary crossing rod 43, a connection element 47 to which the auxiliary crossing rod 43 and the dividing cord sleeve 44 can be coupled.

The moved-out auxiliary crossing rod 43 thus surrounds the dividing cord sleeve 44 which is fixed in the sleeve mounting 45 and which, moreover, has approximately the same outside diameter as the auxiliary crossing rod. The sleeve mounting 45 is subsequently opened, so that the entire circumferential region of the dividing cord sleeve 44 is exposed. This makes it possible for the divided composite thread structure to be stripped off from the auxiliary crossing rod 43 onto the drawn-off dividing cord 49.

This purpose is served by a thread stripper 48 which is illustrated in FIG. 15*a* and which is displaceable in the direction toward the dividing cord sleeve 44. FIGS. 15*a*/15*b* show a shedding comb 40 in the position of readiness, that is to say with comb ends 42 projecting away radially outwards. The auxiliary crossing rod 43 is also drawn back, so that, according to FIG. 16, the shedding comb can be wound over. In this case, the upper threads 43 in each case lie in the U-shaped comb ends 42 and the lower threads 52 lie between the comb ends directly on the comb shank 41. The distance between the lower and the upper threads forms the open shed 51. Depending on the width of the subsequent warping strip, the entire shedding comb or only a portion of this is wound over.

As soon as all the active working threads have been leased into the shedding comb, according to FIG. 17 the auxiliary crossing rod 43 is moved out and the shedding comb 40 is subsequently rotated back into its radially inner position of rest.

This situation is illustrated in FIG. 18. The upper threads 53 then rest directly on the auxiliary crossing rod 43 and the lower threads 52 rest, as before, on the comb shank 41. The auxiliary crossing rod 43 has surrounded the dividing cord sleeve 44 on the end face and the latter is freed from the sleeve mounting 45. Then, according to FIG. 19, the thread stripper 48 can be pushed forward and strips off the lower and upper threads 52/53 beyond the dividing cord sleeve 44 onto the dividing cord 49. The thread stripper 48 subsequently moves back again and the shedding comb 40 remains in this standby position according to FIG. 20 until it is rotated out for new shedding.

Shedding at the end of a lap takes place by similar means to the lap start, that is to say likewise by means of shedding combs. These upper or outer shedding combs, as already mentioned initially, are assigned to the outer ring 14, the diameter of which is dimensioned such that it is larger than the largest possible lap diameter. Contrary to the lap start, however, the dividing element introduced into the open shed is not a dividing cord, but, instead, a flexible dividing band, the design of the shed dividing means and the method steps not being the same as on the inside. According to FIGS. 21*a*/21*b*, a curved shedding comb 40 with comb ends 42 is likewise arranged on a comb shank 41. The flexible dividing band 54 with its angled end portion 58 is arranged beneath the comb shank 41 and can be pushed forward from the inside of the drum. An upper auxiliary crossing rod 56 can likewise be moved out parallel to the comb shank 41. Moreover, a stripping sleeve 57 is provided which surrounds the entire auxiliary crossing rod 56. In the initial position illustrated, once again, lower threads 52 and upper threads 53 are leased into the shedding comb 40, that is to say the thread guides 21 (FIG. 9*a*) assigned to each thread ensure that the threads assume the correct winding-over position.

According to FIG. 22, the leasing process is concluded and the auxiliary crossing rod 56 is moved into the open shed 51. Subsequently, according to FIGS. 23*a*/23*b*, the comb shank 41 is turned down, so that the upper threads 53 lie on the auxiliary crossing rod 56 and the lower threads 52 lie on the comb shank 41.

In a next step according to FIG. 24, the stripping sleeve 57 is moved out, the lower threads 52 falling onto the dividing band 54. By contrast, the upper threads 53 initially still lie on the end of the auxiliary crossing rod 56. The end of the auxiliary crossing rod is in this case approximately in alignment with the angled end of the dividing band 54.

As soon as the stripping sleeve 57 covers the last travel distance, the upper threads 53 fall onto the finished lap, but outside the dividing band 54 (FIG. 25). The dividing element is consequently introduced and, to form a division on the next following lap, can be pushed forward by the amount of a lap width. With the aid of the end portion 58, thread distribution can thus be maintained. The shedding comb 40 is again rotated into the active position for shedding, and the auxiliary crossing rod 56 and stripping sleeve 57 are drawn back into the initial position (FIG. 26). Of course, the method described with reference to FIGS. 21*a*/21*b* to 26 may also be employed at the lap start or on the inner ring. Such a method sequence is illustrated in FIGS. 41*a*/41*b* to 44*a*/44*b*.

A complete winding sequence is described below with reference to the diagrammatic illustration according to FIG. 27. The diagram shows, from the bottom upward, the individual winding sequences, specifically with a viewing direction at right angles to the drum. In the upper third of the figure, the viewing direction runs tangentially to the warping drum 2 having the cylindrical portion 3 and the conical portion 4, and with an already finished lap 37. The lower two thirds of the illustration show virtually a development of the drum casing in the various operating sequences, the angular position of the drum being indicated on the right.

A winding process commences with the feed phase 60, in which, as described above, the thread selection device 8 transfers the working threads 18 with the aid of the active thread guides 21A of the drum and brings them into the correct relative position. All together six active thread guides 21A are illustrated in the diagram. In the case of two passive thread guides 21P, the corresponding thread guide modules remain in their neutral position of readiness in which the stock threads 19 rest.

In the lower winding-over phase 61, the working threads 18 are leased into the lower shedding combs 40 with the aid of the active thread guides 21A. As described above, the divided threads are pushed onto the dividing cord, and the active thread guides 21A, on the one hand, subsequently move the threads together to the width B of the warping strip 17 and, on the other hand, at the same time to the left to the foot point 38 of the conical portion 4. At the end of this process, the drum has covered a revolution of 360°.

The actual winding phase 62 for building up the lap 37 then follows, and, depending on the thread quality, sufficient drum revolutions N×360° are required for the desired lap height H to be reached.

After the lap 37 is finished, the upper winding-over phase 63 for reading in the threads into the upper shedding combs 40 on the outer ring 14 follows. For this purpose, the active thread guides 21A move even further to the left and at the same time apart from one another again to the reading in width respectively leasing width. For shedding and for pushing the dividing strip forward into the open sheds, the drum again requires a full revolution of 360°.

The thread guides 21A subsequently move together into a row in order jointly to transfer the working threads 18 to the outer thread driver 31, the thread guide modules cutting the working threads and again clampingly picking them up. This action is illustrated as an upper feed phase 64.

Without the drum being stopped, the next lap can then be wound in the same way, during which other threads are possibly called up on the thread selection device 8. Clearly, in this case, the inner ring 12, the outer ring 14 and also the thread selection device 8 move to the right by the amount of a strip width B.

FIGS. 28*a* and 28*b* illustrate shedding combs for size distribution. With the aid of a first shedding comb 40' (FIG. 28*a*), in each case a first thread is deposited into a comb end 42' arranged at the start of the comb. Further comb ends are arranged at predetermined periodic intervals from one another, with the result that individual threads in each case form a shed. A dividing element, for example an auxiliary crossing rod, can be led through this shed. A next second shedding comb 40" (FIG. 28*b*) following the first shedding comb has comb ends 42" for a second thread or second threads, the comb ends of the second shedding comb being offset with respect to the first shedding comb by the amount of one thread location. The next shedding combs are designed similarly, that is to say, in the third shedding comb, the respective comb ends will be offset by the amount of a further location, etc. In the example according to FIG. 28*a*/*b*, seven shedding combs would consequently be necessary for size distribution.

Figure 29B:
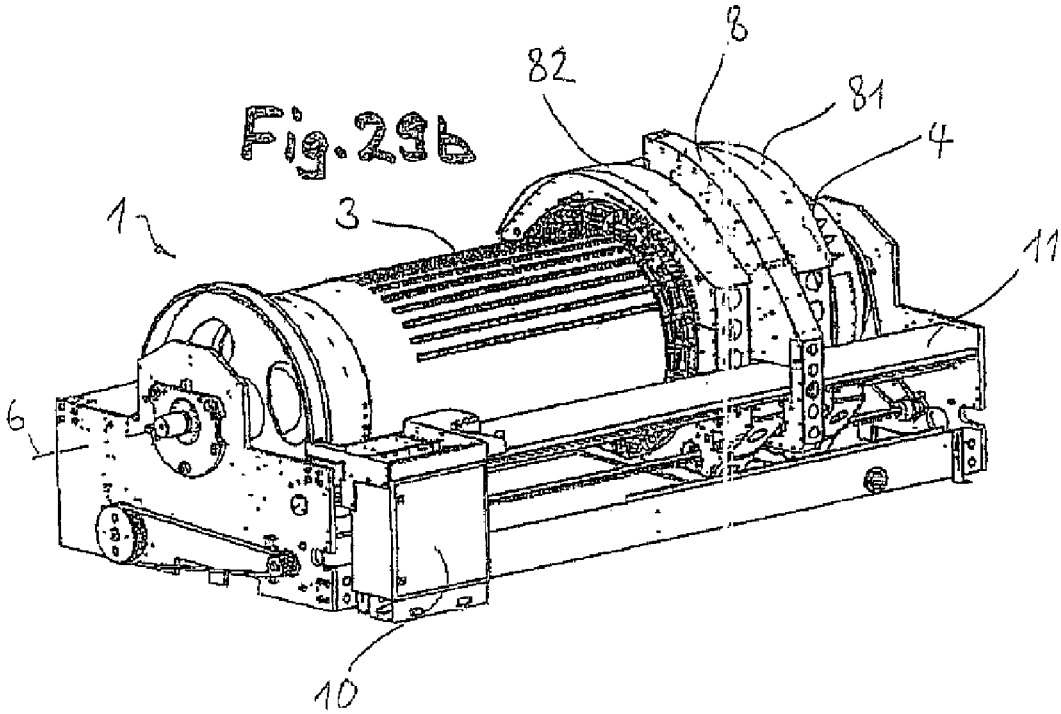

FIGS. 29*a* and 29*b* show a relatively detailed illustration of a warping frame 1. In contrast to the warping frame according to FIGS. 1/2, the inner ring for shedding is designed in such a way that it surrounds the drum casing concentrically and can be driven synchronously with the drum 2 (instead of being arranged directly on the drum). The inner ring is in this case assigned to a thread distribution unit, designated by 82, and the outer ring is assigned to a thread distribution unit, designated by 81. The thread selection device 8 is arranged between the units 81 and 82, as can be seen clearly.

FIG. 30 shows diagrammatically the whole of the mechanical functional groups on the warping frame together with the drive motors belonging to them, to be precise, essentially, the warping drum 2, the stand 5, the warping table 7 and the thread selection device 8. Included in these are the inner thread distribution unit 82 with the inner ring 12 and the outer thread distribution unit 81 with the outer ring 14, together with the respective actuation means. Shedding combs 40 are fastened in each case to the inner ring 12 and to the outer ring 14. As is clear, both the inner ring 12 and the outer ring 14 are elements which are released from the warping drum 2, but can be driven in rotation synchronously with the warping drum 2.

The diagrammatic illustration according to FIG. 31 differs from FIG. 30 essentially in that, here the inner thread distribution unit 82 with the inner ring 12 and the outer thread distribution unit 81 with the outer ring 14 are designed to be movable separately from one another in the direction of the drum axis of rotation 6 (the drives provided for this purpose are designated by RAA and RAI). It can then be seen from FIG. 31 that the ring elements 12 and 14 are provided in the region of their outer casings with a toothed rim drivable in rotation via a drive shaft 66. What can be seen, further, are dividing bands 54 (54',for thread distribution at the start of a strip, 54" for thread distribution at the end of a strip) which are mounted in the drum interior, are deflectable via the drum end and can be displaced parallel to the drum casing. The corresponding thread strippers 48 can then be seen. As regards the thread selection device, the warping frame according to FIG. 31 differs from FIG. 30 in that the thread selection device 8 can be drivable separately from the warping slide 7 (drive 77).

FIGS. 32 and 33 show enlarged details of the warping frame 1 according to FIGS. 29*a*/29*b*. To make it easier to see the thread guide modules 21, however, the inner thread distribution unit has been moved away outside the detail of the figures. The working threads 18 can be seen from FIG. 33 and are indicated by continuous lines. These are wound onto the warping drum 2 during a warping operation. The remaining threads (stock threads) of the thread group 9 are indicated by broken lines.

FIGS. 34 to 35 illustrate in detail a thread distribution unit with the means for beating up a lease and for introducing a dividing element. An outer thread distribution unit would be constructed in the same way as the inner thread distribution unit 82 shown here. The thread distribution unit has an annular configuration. It contains a housing 68, in which the inner ring 12 (see FIG. 35) is mounted with the aid of rollers 74. Further, on that side of the housing 68 which faces the thread selection device (not shown), a slotted device 73 for activating and moving the shedding comb 40 (pivoting movement), the auxiliary crossing rod and the thread stripper (a translational movement in each case) is provided. Details of the slotted device can be seen from the following FIG. 37.

As FIG. 37 shows, electrically actuatable deflectors are provided for activating the respective slotted arrangements. By means of a deflector 71, the thread stripper 48 can be transferred into this slotted arrangement 70, with the result that said thread stripper can be displaced in the f-direction from a position of rest (FIG. 37) into a moved-out position as a result of the rotational movement of the winding body. For this purpose, the thread stripper 48 has arranged on it a pin 76 which cooperates with the slotted arrangement 70. The auxiliary rod (which cannot be seen in FIG. 37) can be moved in the same way by means of a separate slot/deflector arrangement. For the two necessary directions of movement (forward, rearward), in each case two deflectors are required. A further deflector 75 serves for generating the pivoting movement for the shedding comb 40 from a position of rest into a shedding position. This pivoting movement may take place by means of an electrically actuatable cam control. Of course, to activate and move the shedding comb, the auxiliary crossing rod and/or the thread stripper or other means could also be used, in particular the means could also be arranged directly in or on the said elements (instead of from outside).

FIG. 38 illustrates a thread distribution unit 82 in a side view. Here, for example, a pin 77 can be seen, by means of which the pivoting movement of the shedding comb 40 can be executed. The shedding comb 40 shown here is distinguished in that it has an auxiliary comb element 65. By means of this auxiliary comb element, a dividing band can be moved by a pulling movement. A corresponding method sequence is illustrated with reference to FIGS. 39*a*/40*a* (top view), 39*b*/40*b* (side view) and 39*c*/40*c* (end view). In this case, FIGS. 39 show the shedding comb 40 in a shedding position. If, then, the shedding comb 40 is transferred into a position of rest as a result of a pivoting movement, the shedding comb comes into engagement with the end portion 58 of the dividing band 54. This dividing band is in this case preferably introduced at the start of a strip lap. If, then, the shedding comb moves from one strip lap to a next strip lap in the direction of the arrow C, the dividing band 54 is automatically drawn along. The auxiliary comb element 65 in this case serves as a stop for the end portion 58. Of course, depending on the design of the shedding comb, an auxiliary comb element could be dispensed with. A dividing band for the end of a strip lap can be moved in a similar way. In the outer thread distribution unit, the displacement of the outer dividing band would advantageously take place by means of a pushing movement. Suspension, as in FIGS. 39 and 40, would therefore not be necessary.

As FIG. 44*a* shows, the dividing band 54 could also be drawn along with the aid of the thread stripper 58 during the strip change.

The invention claimed is:

1. A method for thread distribution on a warping frame with a winding body for winding a strip lap consisting of a plurality of threads, characterized in that, particularly at the start and/or at the end of a strip lap, a shed for beating up a lease or for size distribution is formed with at least some of the threads at at least one location in a circumferential region of the winding body while the winding body is rotating, and in that a dividing element, in particular a dividing cord or an auxiliary crossing rod, is introduced into the open shed.

2. The method as claimed in claim 1, wherein the shed is formed with the aid of shedding combs which are arranged in the circumferential region of the winding body and which rotate together or synchronously with the winding body.

3. The method as claimed in claim 1, wherein the shed is formed by threads being deposited onto shedding combs which are arranged on a ring element corotating synchronously with the winding body and surrounding the latter.

4. The method as claimed in claim 1, wherein, at the start of a strip lap, the shed is formed by threads being deposited onto shedding combs which are arranged on the winding body.

5. The method as claimed in claim 3, wherein shedding takes place by similar means at the start and at the end of a strip lap, the ring element being an inner ring for thread distribution at the start of the strip lap and an outer ring for thread distribution at the end of the strip lap.

6. The method as claimed in claim 1, wherein, for beating up the lease, at least two shedding combs arranged one behind the other with respect to the circumferential direction are moved out of a position of rest approximately tangential to the outer circumference into a shedding position, in which the comb ends project radially away from the outer circumference, and in that, in the course of a winding body rotation, the threads are preferably deposited alternately onto the comb ends and between the comb ends.

7. The method as claimed in claim 6, wherein an auxiliary crossing rod is introduced into the open shed, in that the shedding comb forming the respective shed is thereafter moved into the position of rest again, and in that, lastly, the threads divided by the auxiliary crossing rod are stripped off onto a dividing element, preferably onto a dividing cord or onto a dividing strip.

8. The method as claimed in claim 7, wherein a plurality of strip laps with an identical or with a different thread repeat are wound one against the other or next to one another onto the winding body, the winding body rotating uninterruptedly, and in that the dividing strip is moved from one strip lap to a next strip lap by the shedding comb by means of a pushing or pulling movement.

9. A device for thread distribution on a warping frame with a winding body for winding a strip lap consisting of a plurality of threads, in particular for carrying out the method as claimed in claim 1, wherein means for beating up a lease and for introducing a dividing element into a shed opened by the lease, while the winding body is rotating, are arranged at at least one location on the circumferential region of the winding body.

10. The device as claimed in claim 9, wherein the means for beating up the lease have at least two shedding combs which are arranged one behind the other with respect to the circumferential direction and approximately parallel to one another and which can be moved out of a position of rest approximately tangential to the outer circumference, in particular by means of a pivoting movement, into a shedding position in which the comb ends project radially away from the outer circumference, the threads being capable of being deposited alternately onto the comb ends and between the comb ends by means of the thread guides.

11. The device as claimed in claim 9, wherein at least a shedding comb forming the respective shed is assigned an auxiliary crossing rod which can be introduced parallel to the shedding comb into the open shed in order to introduce the dividing element.

12. The device as claimed in claim 11, wherein the dividing element is a dividing cord which can be drawn off from a dividing cord store held next to the shedding comb on the axis of movement of the auxiliary crossing rod, and in that next to the auxiliary crossing rod is arranged a thread stripper, by means of which the tensioned threads can be pushed onto the dividing cord via the auxiliary crossing rod fastened on the end face to the dividing cord store and via the dividing cord store.

13. The device as claimed in claim 11, wherein on the winding body runs a dividing band which is displaceable parallel to the winding body casing and which has an end portion projecting radially away from the outer circumference, and in that next to the auxiliary crossing rod is arranged a thread stripper, by means of which the tensioned separated threads can be pushed from the auxiliary crossing rod onto the dividing band, thread distribution being capable of being maintained with the aid of the end portion.

14. The device as claimed in claim 13, wherein the dividing band is a flexible dividing band which is mounted in the drum interior, can be deflected via the drum end and is displaceable parallel to the winding body casing.

15. The device as claimed in claim 9, wherein it has at least one ring element which can be driven in rotation synchronously with the winding body and surrounds the latter and on which the means for beating up a lease while the winding body is rotating are arranged at at least one location on the circumferential region, the ring element being an inner ring for thread distribution at the start of a strip lap and/or an outer ring for thread distribution at the end of a strip lap.

16. The device as claimed in claim 9, wherein the means for beating up a lease at the start of a strip lap are assigned to the winding body, these being arranged on an inner ring which is displaceable on the winding body surface and which can be displaced synchronously or asynchronously with the outer ring drivable in rotation by means of the winding body and surrounding the latter, for thread distribution at the end of a strip lap.

17. The device as claimed in claim 15, wherein the ring element is provided in the region of its outer casing with a toothed rim which can be driven in rotation synchronously with the winding body via a drive shaft.

18. The device as claimed in claim 15, wherein means for displacing the auxiliary crossing rod into an open shed and/or out of an open shed are provided, which are operatively connected to an auxiliary crossing rod/slotted arrangement which surrounds the winding body and which can be activated by means of deflectors, and/or means for displacing the thread stripper are provided, which are operatively connected to a thread stripper/slotted arrangement which surrounds the winding body and which can be activated by means of deflectors.

19. The device as claimed in claim 15, wherein means for pivoting shedding combs 45 from the position of rest into the shedding position and in the opposite direction are provided, which can be activated mechanically by means of an electrically actuable cam control.

* * * * *